US005926160A

United States Patent [19]

Furuya

[11] Patent Number: 5,926,160

[45] Date of Patent: Jul. 20, 1999

[54] APPARATUS FOR DISPLAYING IMAGE ON LIQUID CRYSTAL PIXELS ARRANGED IN MATRIX LAYOUT

[75] Inventor: Masato Furuya, Yokosuka, Japan

[73] Assignee: Victor Company of Japan, Ltd., Yokohama, Japan

[21] Appl. No.: 08/773,902

[22] Filed: Dec. 27, 1996

[30] Foreign Application Priority Data

Jul. 31, 1995 [JP] Japan ..... 7-215355
Dec. 28, 1995 [JP] Japan ..... 7-353502

[51] Int. Cl.[6] ..... G09G 3/36

[52] U.S. Cl. ..... 345/98; 345/90; 345/89; 345/205

[58] Field of Search ..... 345/90, 92, 94, 345/95, 98, 89, 147, 206, 208, 97, 100, 101, 205; 349/48

[56] References Cited

U.S. PATENT DOCUMENTS 4,532,506 7/1985 Kitazima et al. ..... 345/90
5,194,974 3/1993 Hamada et al. ..... 349/48

FOREIGN PATENT DOCUMENTS 3-34077 5/1991 Japan .

*Primary Examiner*—Richard A. Hjerpe
*Assistant Examiner*—Francis N. Nguyen
*Attorney, Agent, or Firm*—Lowe Hauptman Gopstein Gilman & Berner

[57] ABSTRACT

A plurality of pixel elements are arranged in a matrix layout, and an alternating current exciting signal having a plurality of exciting pulses is supplied to each pixel element. Each pixel element has a first MOS-FET in which one picture signal is received at a drain every one horizontal scanning period, one scanning signal is received at a gate every one frame period and a charge signal having a charge voltage relating to a picture voltage of the picture signal is output from a source, a second MOS-FET in which the alternating current exciting signal is received at a drain, the charge signal is received at a gate and a pixel electrode voltage of a pixel electrode signal relating to the charge voltage is output from a source, a condenser for maintaining the charge voltage of the charge signal until a next frame period, and a liquid crystal displaying device for emitting light according to the pixel electrode signal to display a pixel image. Because the pixel electrode voltage relates to the picture voltage, a brightness of the pixel image relates to the picture signal, so that an excellent displaying characteristic in gray scale. Also, a frequency of the pixel electrode signal is the same as that of the alternating current exciting signal, so that any flicker in an image composed of the pixel images can be prevented.

12 Claims, 11 Drawing Sheets

FIG. 10(a)
FIG. 10(b)
FIG. 10(c)
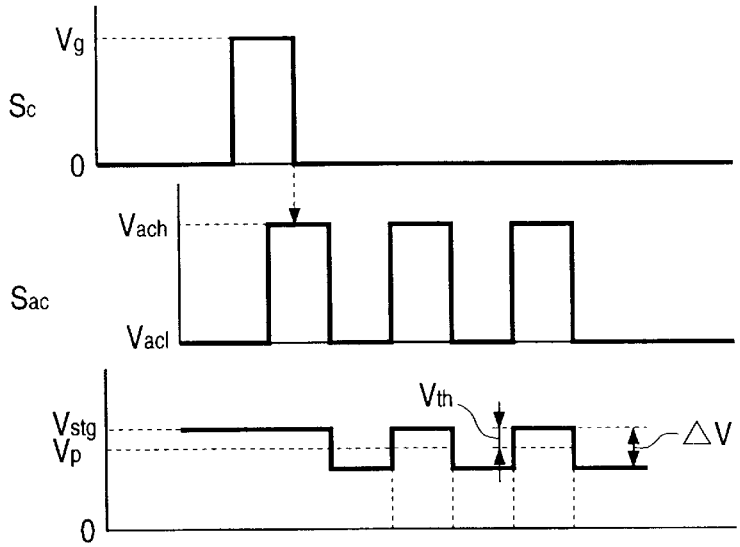
FIG. 11(a)
FIG. 11(b)
FIG. 11(c)
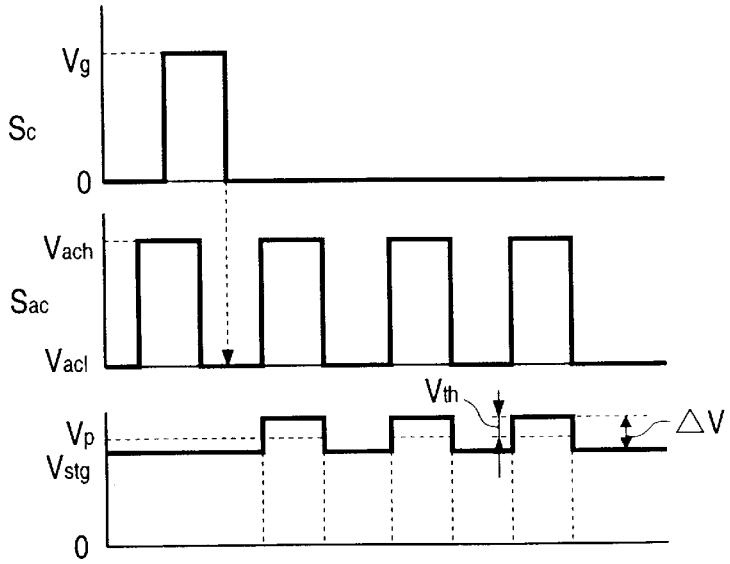

FIG. 16
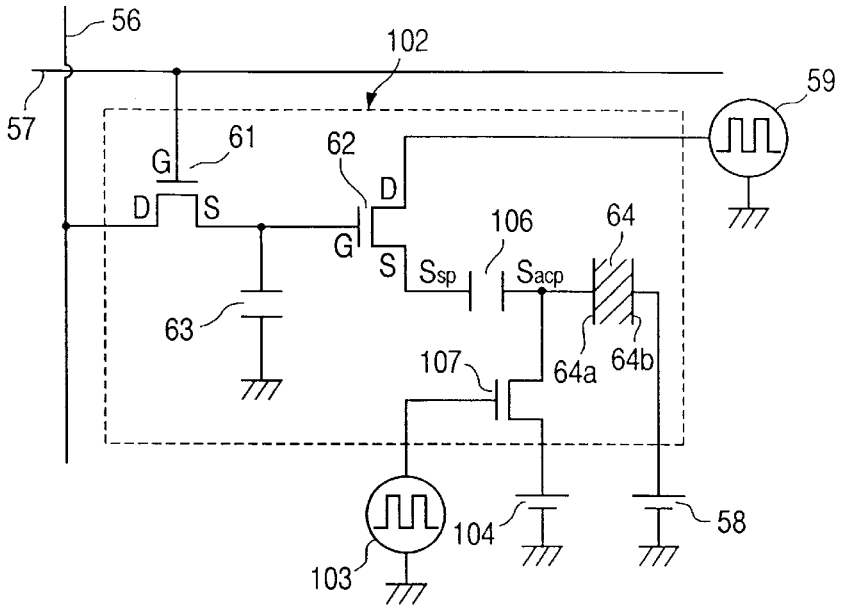
FIG. 17(a)
FIG. 17(b)
FIG. 17(c)
FIG. 17(d)
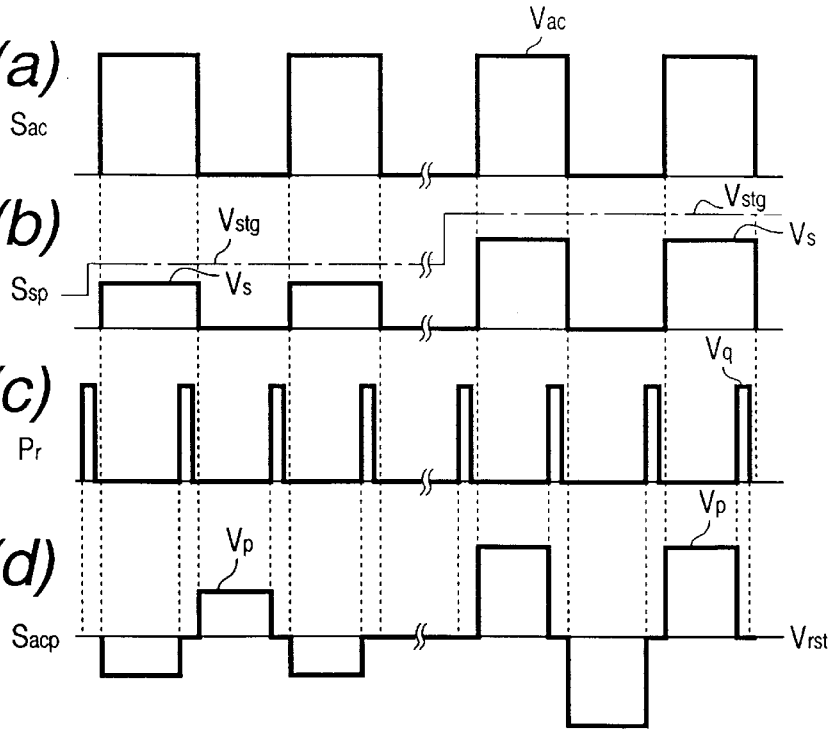

APPARATUS FOR DISPLAYING IMAGE ON LIQUID CRYSTAL PIXELS ARRANGED IN MATRIX LAYOUT

BACKGROUND OF THE INVENTION

1. Field of the Invention

The present invention relates to a liquid crystal displaying apparatus in which an image having no flicker is displayed and a display characteristic in gray scale is excellent.

2. Description of the Related Art 2.1. First Previously Proposed Art

FIG. 1 is a block diagram of a conventional matrix type liquid crystal displaying apparatus, and FIG. 2 is a circuit view of a pixel element arranged in an image displaying unit of the conventional matrix type liquid crystal displaying apparatus. The pixel element of FIG. 2 is disclosed in a patent gazette No. H3-34077 (1991) (corresponding to U.S. Pat. No. 4,532,506) as an invention of Kitazima and Kawakami.

As shown in FIG. 1, a conventional matrix type liquid crystal displaying apparatus 31 is composed of an X directional shift register 33 for outputting a plurality of pixel signals CP one after another in an X direction every one horizontal scanning period (or 1 H time-period), a Y directional shift register 35 for outputting a plurality of 1 H scanning time signals one after another in a Y direction every one frame period, a first buffer 34 for outputting a plurality of picture signals corresponding to the pixel signals CP output from the X directional shift register 33 one after another, a second buffer 35 for outputting a plurality of scanning signals corresponding to the 1 H scanning time signals output from the Y directional shift register 35 one after another, an image displaying unit 32 for displaying an image according to the picture signals transmitted from the first buffers 34 through a plurality of source signal lines 11 and the scanning signals transmitted from the second buffers 36 through a plurality of gate signal lines 12, and a voltage supplying circuit 37 for supplying a reference voltage to a plurality of pixel elements 30 of the image displaying unit 32.

In the above configuration, a plurality of pixel signals CP are output one after another from a plurality of first output terminals $r_1$ to $r_n$ of the X directional shift register 33 arranged in series in the X direction, in synchronization with each horizontal scanning time signal (or clock pulse) D. Therefore, the pixel signals CP are output to the first buffer 34 every one horizontal scanning period (1 H time-period). Also, a plurality of frame time signals FST are output one after another from a plurality of second output terminals $s_1$ to $s_n$ of the Y directional shift register 35 arranged in series in the Y direction as a plurality of 1 H scanning time signals, in synchronization with a plurality of line start signals (or a plurality of 1 H start signals) LST. Therefore, each of the 1 H scanning time signals corresponds to 1 H time-period (one horizontal scanning period), and the 1 H scanning time signals are output to the second buffer 36 every one frame period.

Thereafter, a plurality of voltages Vs1 to Vsn corresponding to the pixel signals CP output from the X directional shift register 33 are produced in the first buffer 34 and are output one after another to the pixel elements 30 of the image displaying unit 32 through the source signal lines 11$a_1$ to 11$a_n$ as a plurality of picture signals. Also, a plurality of voltages Vg1 to Vgn corresponding to the 1 H scanning time signals output from the Y directional shift register 35 are produced in the second buffer 36 and are output one after another to the pixel elements 30 of the image displaying unit 32 through the gate signal lines 12$a_1$ to 12$a_n$ as a plurality of scanning signals. Also, a reference voltage is supplied from the voltage supplying circuit 37 to the pixel elements 30 of the image displaying unit 32.

In the image displaying unit 32, the pixel elements 30*a*1, 30*a*2, . . . , 30*an*, . . . , 30*n*1, 30*n*2, . . . , 30*nn* are arranged in the X and Y directions in a matrix layout. For example, the pixel elements 30*a*1, 30*a*2, . . . , 30*an* are arranged on a first line extending in the X direction, and the pixel elements 30*n*1, 30*n*2, . . . , 30*nn* are arranged on a final line extending in the X direction.

As shown in FIG. 2, each of the pixel elements 30 is composed of a first MOS-FET (metal oxide semiconductor field effect transistor) 13 in which a gate G is connected with one gate signal line 12 and a drain D is connected with one source signal line 11, a second MOS-FET 14 in which a gate G is connected with a source S of the first MOS-PET 13 and a drain D is connected with the gate signal line 12, a condenser 15 for charging a voltage Vat to the gate G of the second MOS-FET 14 and discharging the voltage Vst to the earth, and a liquid crystal displaying device 16 for emitting light according to one scanning signal transmitted through the gate signal line 12.

In the above configuration, a piece of voltage information such as a voltage Vs1 or a zero voltage is maintained in the first MOS-FET 13 and the condenser 15 during one frame period for each pixel element 30. Also, a piece of pixel information is maintained in the second MOS-FET 14 and the liquid crystal displaying device 16 during one frame period for each pixel element 30, and the pixel information is displayed by the liquid crystal displaying device 16.

In detail, one voltage Vs of one picture signal corresponding to each of the pixel signals CP is supplied from the first buffer 34 to the drain D of one first MOS-FET 13 through one source signal line 11. Also, one voltage Vg1 of one scanning signal corresponding to each of the 1 H scanning time signals synchronized with one frame time signal FST is supplied from the second buffer 36 to the gate G of the first MOS-FET 13 through one gate signal line 12, and the first MOS-FET 13 is set to an "on" condition and is turned on. Therefore, the voltage Vs of the picture signal is charged to the condenser 15 through the drain D of the first MOS-FET 13 and the source S of the first MOS-FET 13, and a charging voltage Vst is applied to the gate of the second MOS-FET 14. Therefore, the second MOS-FET 14 is set to an "on" condition and is turned on. The charging voltage Vst is maintained by the condenser 15 until another voltage Vg1 corresponding to one scanning signal synchronized with one frame time signal FST is supplied to the gate G of the first MOS-FET 13 in a next frame.

Also, the voltage Vg1 of the scanning signal is applied to the drain D of the second MOS-FET 14 when the second MOS-FET 14 is set to the "on" condition, and the voltage Vg1 is applied to one electrode 16*a* of the liquid crystal displaying device 16 through the second MOS-FET 14. In this case, an alternating current exciting voltage is superimposed on the scanning signal, and a reference voltage is applied from the voltage supplying circuit 37 to a common electrode 16*b* of the liquid crystal displaying device 16. Therefore, the liquid crystal displaying device 16 is actuated according to the alternating current exciting voltage, and light is emitted from the liquid crystal displaying device 16.

Accordingly, because the liquid crystal displaying device 16 is actuated at the same frequency with that of the alternating current exciting voltage supplied from the outside, an image can be displayed in the pixel elements 30 of the image displaying unit 32 without any flicker. However, it is difficult to obtain an excellent display characteristic in gray scale. That is, it is difficult to distinguish a large number of gray degrees, ranging from a gray degree corresponding to a white to a gray degree corresponding to a black, from each other in an image.

2.2. Second Previously Proposed Art

Another conventional liquid crystal displaying apparatus in which an image is displayed in gray scale is known. However, in this liquid crystal displaying apparatus, because an actuating frequency for a liquid crystal displaying device is limited to a field frequency (60 Hz) or a frame frequency (30 Hz), so that there is a drawback that a flicker occurs in an image displayed by using the apparatus. Therefore, it is difficult that the conventional liquid crystal displaying apparatus obtains an excellent display characteristic in gray scale without any occurrence of a flicker.

As an example of the conventional liquid crystal displaying apparatus in which an image is displayed in gray scale, a matrix displaying apparatus disclosed in a patent gazette No. H3-34077 (1991) is described with reference to FIG. 3.

In this matrix displaying apparatus, the second MOS-FET 14 is omitted from each pixel element. That is, as shown in FIG. 3, each pixel element 41 in this matrix displaying apparatus is composed of a first MOS-FET 44 in which a gate G is connected with a gate signal line 43 and a drain D is connected with a source signal line 42, a condenser 45 of which one end is connected with a source S of the first MOS-FET 44, and a liquid displaying device 46 of which one electrode 46*a* is directly connected with the source S of the first MOS-FET 44.

In the above configuration, a piece of voltage information such as a voltage Vs or a zero voltage is maintained in the first MOS-FET 44 and the condenser 45 during one frame period for each pixel element 41. Thereafter, an actuating voltage Va relating to the maintained voltage Vs is applied to the electrode 46*a* of the liquid displaying device 46, and a piece of pixel information is displayed by the liquid crystal displaying device 46 during one frame period for each pixel element 41. In this case, the voltage Vs of a picture signal Sp applied to the drain D of the first MOS-FET 44 through the source signal line 42 is changed to change the actuating voltage Va applied to the electrode 46*a* of the liquid displaying device 46. Therefore, the brightness of the liquid displaying device 46 can be controlled by changing the voltage Vs of the picture signal Sp, so that an excellent display characteristic in gray scale can be obtained in the matrix displaying apparatus.

3. Problems to be Solved by the Invention

However, in the conventional matrix type liquid crystal displaying apparatus 31 disclosed as the invention in patent gazette No. H3-34077 (1991), because the liquid crystal displaying device 16 is actuated by applying the alternating current exciting voltage superimposed on the scanning signal or a zero voltage to the liquid crystal displaying device 16 through the gate signal line 12 and the second MOS-FET 14, a display characteristic in gray scale is not obtained in the conventional matrix type liquid crystal displaying apparatus 31 disclosed in the patent gazette No. H3-34077 (1991) as the invention.

Also, in the matrix displaying apparatus disclosed as prior art in the aforementioned patent gazette No. H3-34077 (1991), a polarity of the voltage Vs of the picture signal Sp applied to the drain D of the first MOS-FET 44 is inverted every field period (1/60 second) or every frame period (1/30 second) to invert a polarity of the actuating voltage Va applied to the liquid crystal displaying device 46 every field period or every frame period for the purpose of actuating the liquid crystal displaying device 46. In this case, the actuating voltage Va is applied to the liquid crystal displaying device 46 at a low frequency such as 30 Hz. Therefore, in cases where a voltage maintaining characteristic in a liquid crystal layer of the liquid crystal displaying device 46 is not sufficient, the actuating voltage Va applied to the liquid crystal displaying device 46 is decreased, so that there is a drawback that a luminance (or brightness) of an image displayed by the matrix displaying apparatus is lowered or a flicker occurs in the image.

SUMMARY OF THE INVENTION

An object of the present invention is to provide, with due consideration to the drawbacks of such a conventional liquid crystal displaying apparatus, a liquid crystal displaying apparatus in which the occurrence of a flicker in an image and the deterioration of a display luminance in the image are prevented and an excellent display characteristic in gray scale is obtained.

The object is achieved by the provision of a liquid crystal displaying apparatus, comprising:

a plurality of pixel elements arranged from a first line of a first column to an M-th line of an N-th column (N and M are respectively an integral number) in a matrix layout;

a picture signal electrode actuating circuit for outputting a plurality of N picture signals having picture voltages to N picture signal electrodes in one-to-one correspondence every one horizontal scanning period, each of the picture signal electrodes being connected with one column of M pixel elements;

a scanning signal electrode actuating circuit for outputting a plurality of M scanning signals having a scanning voltage to X scanning signal electrodes in one-to-one correspondence every one frame period corresponding to M horizontal scanning periods, each of the scanning signal electrodes being connected with one line of N pixel elements; and an alternating current exciting signal outputting circuit for outputting an alternating current exciting signal having a plurality of exciting pulses of an exciting voltage and an exciting frequency, each of the pixel elements comprising a first switch for receiving one picture signal output from the picture signal electrode actuating circuit and outputting a charge signal set at a charge voltage relating to the picture voltage of the picture signal in cases where one scanning signal output from the scanning signal electrode actuating circuit is received;

a second switch for receiving the exciting pulses of the alternating current exciting signal output from the alternating current exciting signal outputting circuit and outputting a pixel electrode signal, of which a pixel electrode voltage is determined according to the charge voltage of the charge signal set by the first switch and a frequency is the same as the exciting frequency of the alternating current exciting signal, in cases where the charge signal is received; and a liquid crystal displaying element for displaying a pixel image according to the pixel electrode signal output from the second switch on condition that a brightness of the pixel image depends on the pixel electrode voltage of the pixel electrode signal.

In the above configuration, M lines and N columns of pixel elements are arranged in an matrix layout, a plurality of N picture signals are output from the picture signal electrode actuating circuit to N columns of pixel elements every one horizontal scanning period, and a plurality of M scanning signals are output from the scanning signal electrode actuating circuit to M lines of pixel elements every one frame period.

In each of the pixel elements, a charge signal is output from the first switch when one scanning signal is received in the first switch. A charge voltage of the charge signal corresponds to the picture voltage of the picture signal. Thereafter, when the charge signal is received in the second switch, a pixel electrode signal having a pixel electrode voltage and a frequency is output from the second switch. The pixel electrode voltage of the pixel electrode signal is determined according to the charge voltage of the charge signal, and the frequency of the pixel electrode signal is the same as the exciting frequency of the alternating current exciting signal. Thereafter, the pixel electrode voltage of the pixel electrode signal is applied to the liquid crystal displaying element, and a pixel image is displayed by the liquid crystal displaying element on condition that a brightness of the pixel image depends on the pixel electrode voltage of the pixel electrode signal.

Accordingly, because the charge voltage of the charge signal output from the first switch is determined in correspondence to the picture voltage of the picture signal and the pixel electrode voltage of the pixel electrode signal applied to the liquid crystal displaying element is determined according to the charge voltage of the charge signal, the brightness of the pixel image displayed by the liquid crystal displaying element is changed with the picture voltage of the picture signal. Therefore, an excellent display characteristic in gray scale can be obtained in the liquid crystal displaying apparatus.

Also, because the frequency of the pixel electrode signal is the same as the exciting frequency of the alternating current exciting signal, the frequency of the pixel electrode signal can be heightened regardless of the frequency of the scanning signal. Therefore, because the pixel electrode voltage of the pixel electrode signal is applied the liquid crystal displaying element at a high frequency, any decrease of a voltage applied to a liquid crystal layer of the liquid crystal displaying element can be prevented, and any flicker occurring in an image composed of the pixel images can be prevented.

It is preferred that a dielectric layer having a specific resistance higher than that of a liquid crystal layer of the liquid crystal displaying element be arranged on the liquid crystal displaying element.

In the above configuration, a direct current voltage component included in the pixel electrode signal is absorbed in the dielectric layer, and only an alternating current voltage component of the pixel electrode signal is applied to the liquid crystal layer of the liquid crystal displaying element. Therefore, a pixel image can be stably displayed in each of the pixel elements.

The first switch is made of a first field effect transistor in which a gate is connected with the scanning signal electrode, a first main terminal is connected with the picture signal electrode and the charge signal is output from a second main terminal, and the second switch is made of a second field effect transistor in which a gate is connected with the second main terminal of the first field effect transistor, a first main terminal is connected with the picture signal electrode actuating circuit and a second main terminal is connected with the liquid crystal displaying element.

In this configuration, it is preferred that the liquid crystal displaying apparatus further comprise a phase synchronizing unit for synchronizing the alternating current exciting signal output from the alternating current exciting signal outputting circuit with the scanning signal applied to the gate of the first field effect transistor to fix a phase relationship between the scanning signal and the alternating current exciting signal.

In this case, even though a parasitic capacitance exists between the gate and drain in the second field effect transistor and functions as a line for transmitting the alternating current exciting signal to the gate of the second field effect transistor, because a phase relationship between the scanning signal and the alternating current exciting signal is fixed, a difference between the charge voltage and the pixel electrode voltage is set to a constant value. Therefore, a brightness of the pixel image displayed by the liquid crystal displaying element can accurately depend on the picture voltage of the picture signal, and nonuniformity in brightness between one line of pixel elements and another line of pixel elements can be prevented.

It is also preferred that a metallic layer be arranged on the second main terminal of the second field effect transistor, a pixel electrode be arranged on the liquid crystal displaying element, and an insulating layer be arranged between the metallic layer and the pixel electrode to connect the second field effect transistor and the liquid crystal displaying element in capacitive coupling.

In the above configuration, because the second field effect transistor and the liquid crystal displaying element are connected with each other in capacitive coupling, a conductive line connecting the second field effect transistor and the liquid crystal displaying element is not required, so that the pixel electrode can has a flat surface. As a result, an area of each pixel element can be enlarged, and a bright image can be displayed.

It is also preferred that a common line connects the alternating current exciting signal outputting circuit and the first main terminal of the second field effect transistor, a pixel electrode is arranged on the liquid crystal displaying element to be connected with the second main terminal of the second field effect transistor, and a metallic shielding layer is arranged between the common line and the pixel electrode.

In the above configuration, even though an electric field is generated by the alternating current exciting signal outputting circuit, because an adverse influence of the electric field on the liquid crystal displaying element is prevented by the metallic shielding layer, a superior image can be reliably displayed by the pixel elements.

The object is also achieved by the provision of a liquid crystal displaying apparatus, comprising:

a plurality of pixel elements arranged from a first line of a first column to an M-th line of an N-th column (N and M are respectively an integral number) in a matrix layout;

a picture signal electrode actuating circuit for outputting a plurality of N picture signals having picture voltages to N picture signal electrodes in one-to-one correspondence every one horizontal scanning period, each of the picture signal electrodes being connected with one column of M pixel elements;

a scanning signal electrode actuating circuit for outputting a plurality of M scanning signals having a scanning voltage to M scanning signal electrodes in one-to-one correspondence every one frame period corresponding to H horizontal scanning periods, each of the scanning signal electrodes being connected with one line of N pixel elements;

an alternating current exciting signal outputting circuit for outputting an alternating current exciting signal having a plurality of exciting pulses of an exciting voltage and an exciting frequency;

a pulse supplying circuit for supplying a plurality of reset pulses of a reset pulse signal to each of the pixel elements;

a direct current voltage source for applying a reference voltage to each of the pixel elements; and a phase synchronizing unit for synchronizing the reset pulse signal output from the pulse supplying circuit with the alternating current exciting signal output from the alternating current exciting signal outputting circuit to output one first reset pulse of the reset pulse signal just before one leading edge of each exciting pulse of the alternating current exciting signal and output one second reset pulse of the reset pulse signal just before one trailing edge of each exciting pulse of the alternating current exciting signal, each of the pixel elements comprising a first field effect transistor for receiving one picture signal output from the picture signal electrode actuating circuit through one picture signal electrode at a first main terminal and outputting a charge signal set at a charge voltage relating to the picture voltage of the picture signal from a second main terminal in cases where one scanning signal output from the scanning signal electrode actuating circuit through one scanning signal electrode is received at a gate;

a second field effect transistor for receiving the charge signal output from the first field effect transistor at a gate, receiving the alternating current exciting signal output from the alternating current exciting signal outputting circuit at a first main terminal and outputting a source pulse signal of which a source pulse voltage is determined according to the charge voltage of the charge signal and a frequency is the same as the exciting frequency of the alternating current exciting signal;

a condenser, of which one terminal is connected with the second main terminal of the second field effect transistor and the other terminal is connected with a connecting line, for removing a direct current voltage component from the source pulse signal output from the second field effect transistor;

a third field effect transistor for receiving the reset pulses of the reset pulse signal output from the pulse supplying circuit at a gate, receiving the reference voltage applied from the direct current voltage source at a second main terminal and outputting an alternating current pulse signal from a first main terminal to the connecting line on condition that a pixel electrode voltage of the alternating current pulse signal is reset to the reference voltage in synchronization with each of the reset pulses, the pixel electrode voltage reset to the reference voltage in synchronization with each first reset pulse is increased to a highest value relating to the source pulse voltage of the source pulse signal applied to the condenser and the pixel electrode voltage reset to the reference voltage in synchronization with each second reset pulse is decreased to a lowest value relating to the source pulse voltage of the source pulse signal applied to the condenser; and a liquid crystal displaying element for displaying a pixel image according to the alternating current pulse signal output from the third field effect transistor through the connecting line on condition that a brightness of the pixel image depends on the pixel electrode voltage of the alternating current pulse signal.

In the above configuration, because a direct current voltage component is removed from the source pulse signal in the condenser and the alternating current pulse signal having no direct current voltage component is applied to the liquid crystal displaying element, a life time of the liquid crystal displaying element can be prolonged, and any baking of the liquid crystal displaying element can be prevented.

Also, because a frequency of the alternating current pulse signal is the same as that of the alternating current exciting signal, a flicker occurring in an image can be prevented.

Also, because the source pulse voltage of the source pulse signal is determined according to the charge voltage of the charge signal and the highest and lowest values of the pixel electrode voltage are determined in correspondence to the source pulse voltage of the source pulse signal, a brightness of an image displayed in the pixel element can accurately depend on the picture voltage of the picture signal, so that an excellent displaying characteristic in gray scale can be obtained.

BRIEF DESCRIPTION OF THE DRAWINGS

The objects, features and advantages of the present invention will be apparent from the following description taken in conjunction with the accompanying drawings, in which:

FIGS. 10(*a*) to 10(*c*) show waveforms of one scanning signal, the alternating current exciting signal Sac, the charge voltage Vstg and the pixel electrode voltage Vp on condition that the alternating current exciting signal Sac indicates the high alternating current voltage Vach at a time of a trailing edge of the scanning signal;

FIGS. 11(*a*) to 11(*c*) show waveforms of one scanning signal, the alternating current exciting signal Sac, the charge voltage Vstg and the pixel electrode voltage Vp on condition that the alternating current exciting signal Sac indicates the low alternating current voltage Vacl at a time of a trailing edge of the scanning signal;

FIG. 16 is a circuit view of a pixel element arranged in an image displaying unit of the matrix type liquid crystal displaying apparatus shown in FIG. 15; and FIGS. 17(*a*) to 17(*d*) are a plurality of timing charts of an alternating current exciting signal Sac, a source pulse signal Ssp, reset pulses Pr and an alternating current pulse signal Sacp.

DETAILED DESCRIPTION OF THE EMBODIMENTS

Preferred embodiments of a matrix type liquid crystal displaying apparatus according to the present invention are described with reference to drawings.

A configuration of a matrix type liquid crystal displaying apparatus according to first to fifth embodiments is described.

Figure 1:
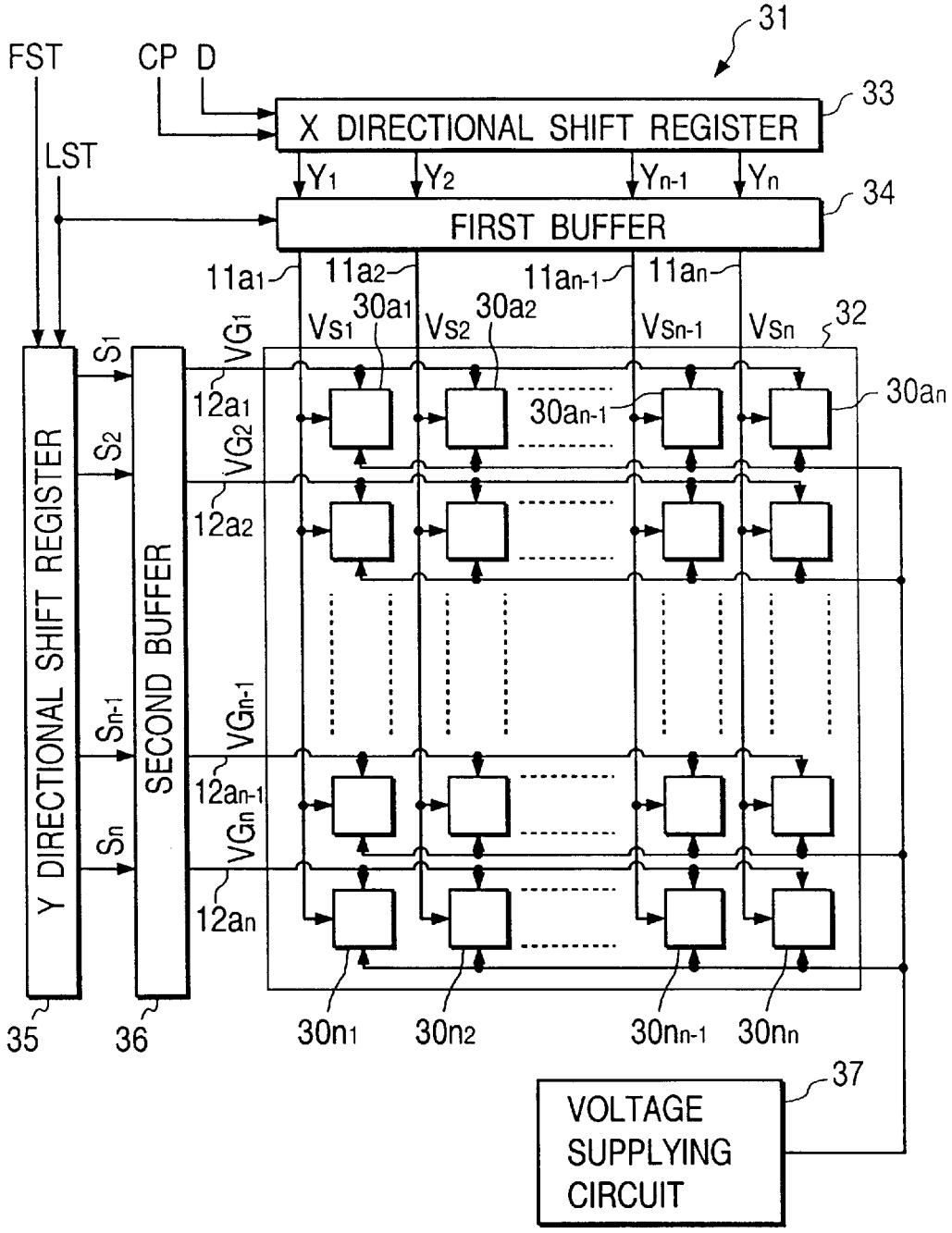
FIG. 1 PRIOR ART
FIG. 1 is a block diagram of a conventional matrix type liquid crystal displaying apparatus.
Figure 2:
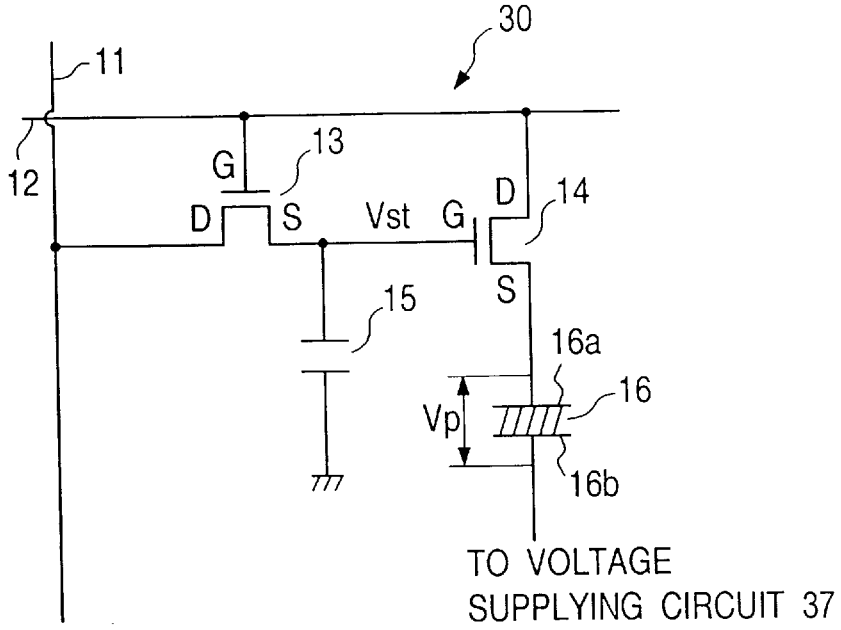
FIG. 2 PRIOR ART
FIG. 2 is a circuit view of a pixel element arranged in an image displaying unit of the conventional matrix type liquid crystal displaying apparatus shown in FIG. 1.
Figure 3:
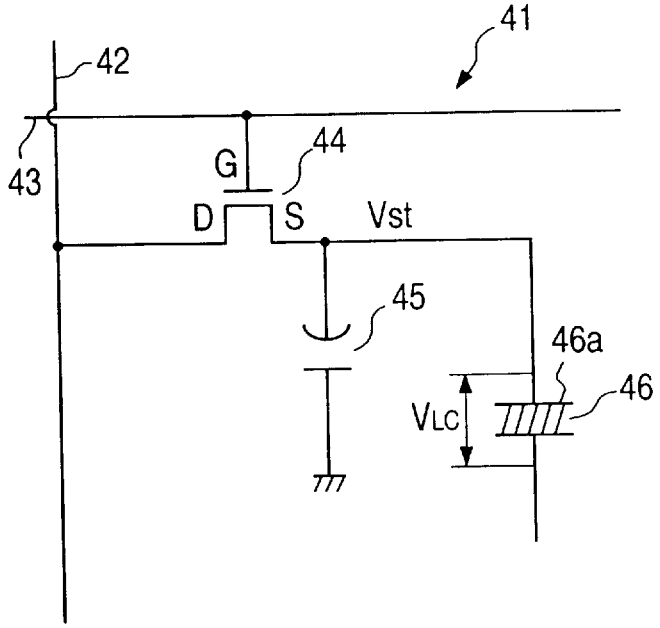
FIG. 3 PRIOR ART
FIG. 3 is a circuit view of a pixel element arranged in an image displaying unit of a matrix displaying apparatus disclosed in a patent gazette No. H3-34077 (1991)
Figure 4:
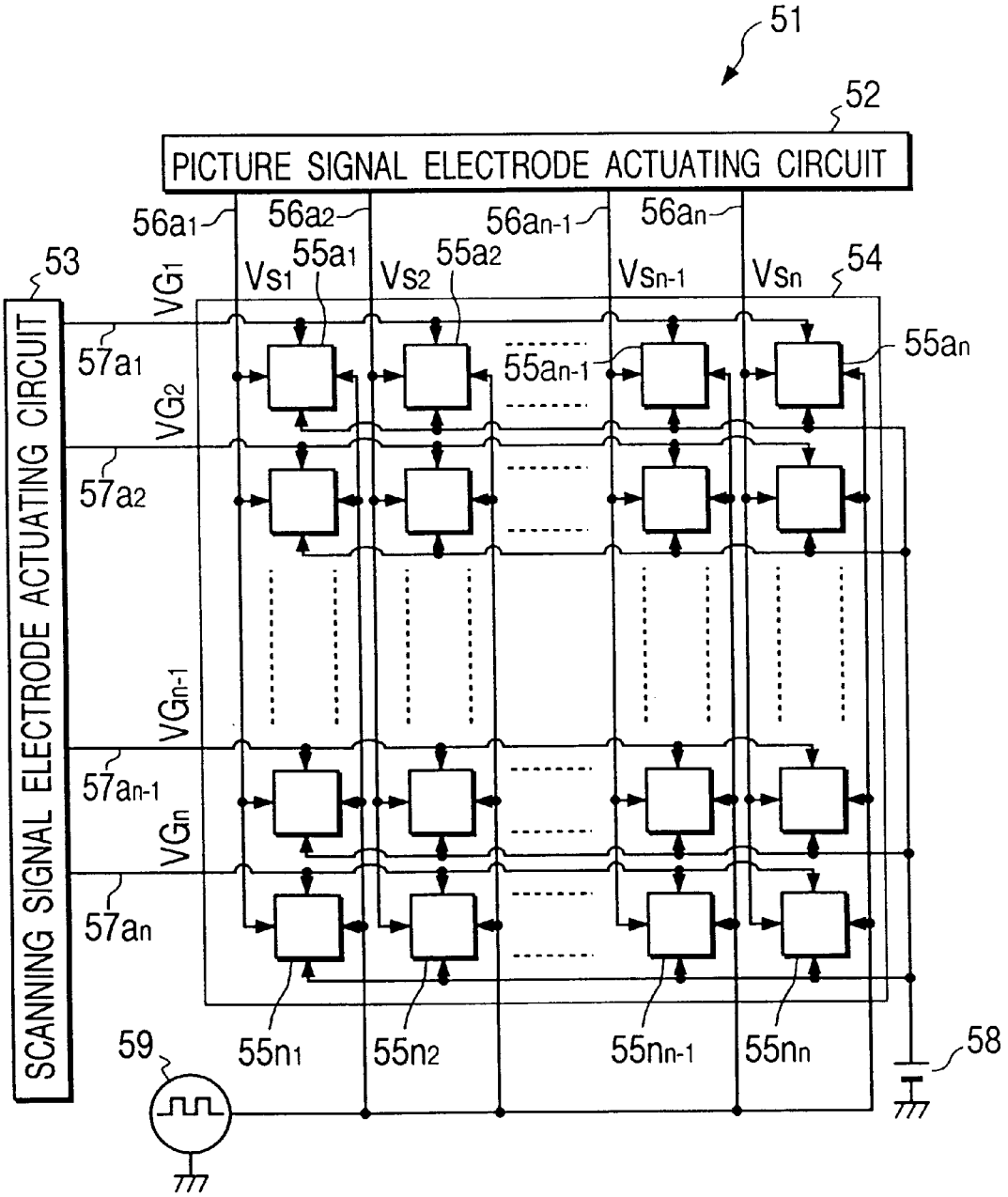
FIG. 4 is a block diagram of a matrix type liquid crystal displaying apparatus according to a plurality of embodiments of the present invention.

FIG. 4 is a block diagram of a matrix type liquid crystal displaying apparatus according to first, second, fourth and fifth embodiments of the present invention.

As shown in FIG. 4, a matrix type liquid crystal displaying apparatus 51 comprises

- a picture signal electrode actuating circuit 52 for receiving a plurality of pixel signals and outputting a plurality of picture signals Sp according to the pixel signals one after another every one horizontal scanning period,
- a scanning signal electrode actuating circuit 53 for receiving a plurality of 1 H scanning time signals and outputting a plurality of scanning signals Sc corresponding to the 1 H scanning time signals one after another every one frame period,
- an image displaying unit 54, composed of a plurality of pixel elements 55, for displaying an image according to the picture signal voltages supplied from the picture signal electrode actuating circuit 52 through a plurality of picture signal electrodes 56 (56*a*1 to 56$a_n$) and the scanning signal voltages supplied from the scanning signal electrode actuating circuit 53 through a plurality of scanning signal electrodes 57 (57*a*1 to 57$a_n$),
- a direct current source 58 for supplying a direct current voltage Vdc to each of the pixel elements 55 of the image displaying unit 54, and
- an alternating current exciting signal supplying circuit 59 for supplying an alternating current exciting signal Sac having a plurality of exciting pulses of a voltage Vach and an exciting frequency to each of the pixel elements 55 of the image displaying unit 54.

In the above configuration, a plurality of voltages Vs (Vs1 to Vsn) of a plurality of picture signals Sp are supplied to the pixel elements 55 of the image displaying unit 54 one after another every one horizontal scanning period through the picture signal electrodes 56*a*1 to 56$a_n$. Also, a plurality of voltages Vg (Vg1 to Vgn) of a plurality of scanning signals Sc are supplied to the pixel elements 55 of the image displaying unit 54 one after another every one frame period through the scanning signal electrodes 57*a*1 to 57$a_n$.

In the image displaying unit 54, the pixel elements 55*a*1, 55*a*2, . . . , 55*an*, . . . , 55*n*1, 55*n*2, . . . , 55*nn* are arranged in the X and Y directions in a matrix layout. For example, the pixel elements 55*a*1, 55*a*2, . . . , 55*an* are arranged on a first line extending in the X direction, and the pixel elements 55*n*1, 55*n*2, . . . , 55*nn* are arranged on a final line extending in the Y direction. An alternating current exciting signal Sac having a plurality of exciting pulses at an exciting frequency is supplied from the alternating current exciting signal supplying circuit 59 to each of the pixel elements 55 of the image displaying unit 54, and a direct current voltage Vdc is supplied from the direct current source 58 to the common electrode 64*b* of the liquid crystal displaying device 64.

Next, a configuration of each pixel element 55 according to the first embodiment is described.

Figure 5:
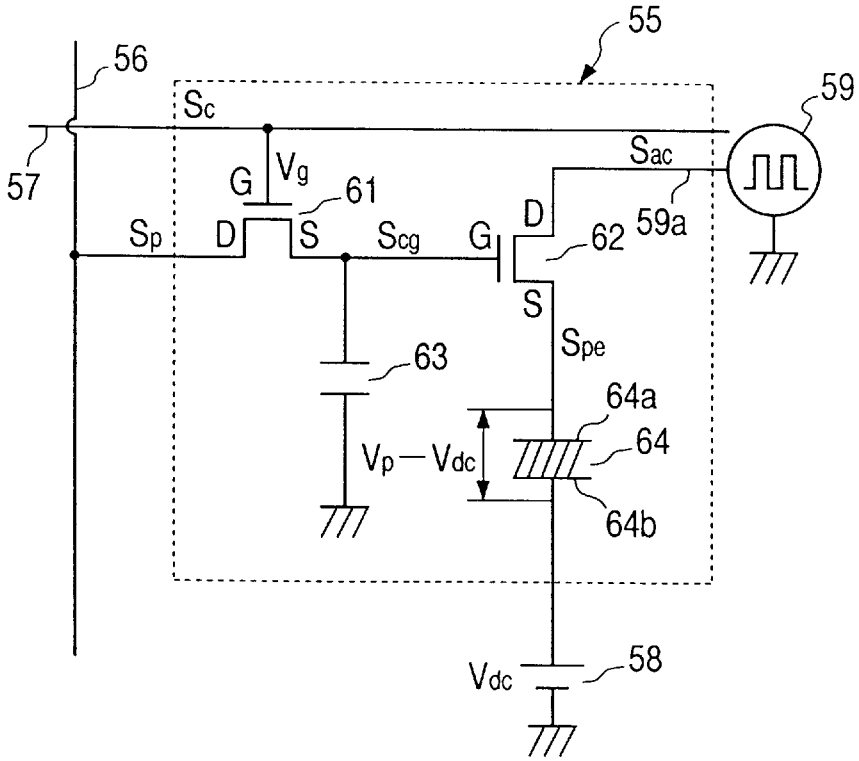
FIG. 5 is a circuit view of a pixel element arranged in an image displaying unit of the matrix type liquid crystal displaying apparatus shown in FIG. 4, according to a first embodiment of the present invention.

FIG. 5 is a circuit view of one pixel element 55 arranged in the image displaying unit 54 of the matrix type liquid crystal displaying apparatus 51, according to the first embodiment of the present invention.

As shown in FIG. 5, each of the pixel elements 55 comprises a first MOS-FET 61, in which a gate G is connected with one scanning signal electrode 57 and a drain D is connected with one picture signal electrode 56, for receiving one picture signal Sp at the drain D and outputting a charge signal Scg having a charge voltage Vstg relating to the picture voltage Vs of the picture signal Sp when one scanning signal Sc is received at the gate G,

- a second MOS-FET 62, in which a gate G is connected with a source S of the first MOS-FET 61 and a drain D is connected with the alternating current exciting signal supplying circuit 59, for receiving an alternating current exciting signal Sac from the alternating current exciting signal supplying circuit 59 and outputting a pixel electrode signal Spe having a pixel electrode voltage Vp when the charge signal Scg is received at the gate G,
- a condenser 63 for maintaining the charge voltage Vstg of the charge signal Scg relating to the picture voltage Vs of the picture signal Sp received by the first MOS-PET 61 each time the scanning signal Sc is received by the first MOS-FET 61, and
- a liquid crystal displaying device 64 having a pixel electrode 64*a* and a common electrode 64*b* for emitting light according to the alternating current exciting signal Sac supplied from the alternating current exciting signal supplying circuit 59 through a common line 59*a* and displaying a pixel image.

A positional arrangement of the MOS-FETs 61 and 62, the condenser 63, the electrodes 56 and 57 and the line 59*a* is described with reference to FIGS. 6 and 7.

Figure 6:
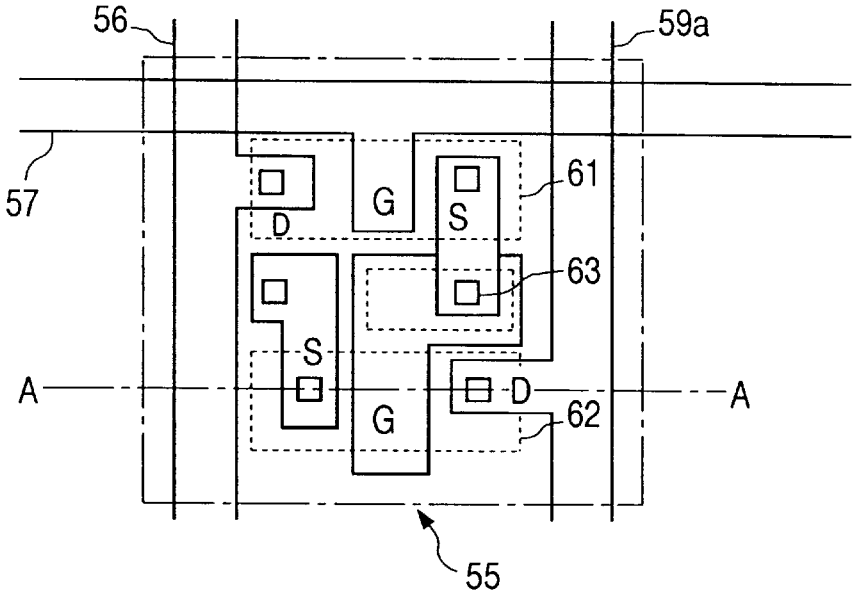
FIG. 6 is a plan view of the circuit of the pixel element shown in FIG. 5.

FIG. 6 is a plan view of the pixel element 55.

As shown in FIG. 6, the condenser 63 is arranged between the MOS-FETs 61 and 62, and the condenser 63 and the MOS-FETs 61 and 62 are surrounded by the signal electrodes 56 and 57 and the common line 59*a*. The signal electrodes 56 and 57 and the common line 59*a* are made from aluminum (Al) metal.

Figure 7:
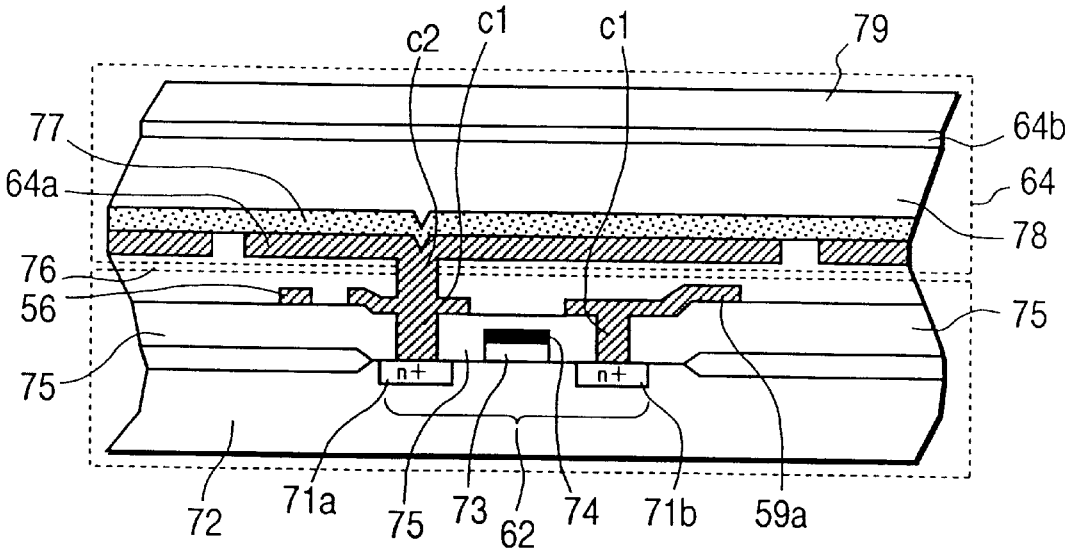
FIG. 7 is a cross sectional view taken generally along a line A—A of FIG. 6.

FIG. 7 is a cross sectional view taken generally along a line A—A of FIG. 6.

As shown in FIG. 7, the liquid crystal displaying device 64 is arranged on the MOS-FET 62. In the MOS-FET 62, a pair of $n^+$ diffused layers 71*a* and 71*b* are arranged in an upper portion of a single-crystal Si substrate 72. The $n^+$ diffused layers 71*a* functions as the source $S_{62}$ of the MOS-FET 62, and the $n^+$ diffused layer 71*b* functions as the drain $D_{62}$ of the MOS-FET 62. A gate oxide film 73 is arranged on a channel portion of the MOS-FET 62 placed between the $n^+$ diffused layers 71*a* and 71*b*, a poli-Si film 74 functioning as a gate electrode $G_{62}$ of the MOS-FET 62 is arranged on the gate oxide film 73, and the $n^+$ diffused layers 71*a* and 71*b* and the poli-Si film 74 are covered with a first insulating layer 75. A pair of contact holes C1 placed on the $n^+$ diffused layers 71*a* and 71*b* are opened and are buried with Al metal functioning as a pair of ohmic electrodes. The common electrode 59*a* and the picture signal electrode 56 made from the Al metal are arranged on the first insulating layer 75. The common electrode 59*a* is electrically connected with the drain $D_{62}$ of the MOS-PET 62. A second insulating layer 76 having a contact hole C2 is arranged on the common electrode 59*a* and the picture signal electrode 56 to separate the MOS-FET 62 from the liquid crystal displaying device 74. The contact hole C2 is placed on the source $S_{62}$ of the MOS-FET 62 and is buried with the Al metal to electrically connect the source $S_{62}$ with the pixel electrode 64*a*.

In the liquid crystal displaying device 64, a dielectric layer 77 is arranged on the pixel electrode 64*a*, and a liquid crystal layer 78 is arranged on the dielectric layer 77. The dielectric layer 77 and the liquid crystal layer 78 are arranged between a flat-plate type glass substrate 79 having the common electrode 64*b* and the pixel electrode 64*a*.

In the above configuration, an operation performed in each pixel element 55 is described.

One picture voltage Vs of one picture signal Sp is applied from the picture signal electrode actuating circuit 52 to the drain D of the first MOS-FET 61 through one picture signal electrode 56. The picture signal Sp is shown in FIG. 8(*a*). Also, when one voltage Vg of one scanning signal Sc is applied from the scanning signal electrode actuating circuit 53 to the gate G of the first MOS-FET 61 through one scanning signal electrode 57 in synchronization with one frame time signal, the first MOS-FET 61 is turned on. The scanning signal Sc is shown in FIG. 8(*b*). Therefore, the picture signal Sp having the picture voltage Vs is transmitted through the first MOS-FET 61, and a charge voltage Vstg relating to the picture voltage Vs of the picture signal Sp is applied to the gate G of the second MOS-FET 62. A charge signal Scg having the charge voltage Vstg is shown in FIG. 8(*c*). Therefore, the second MOS-FET 62 is turned on. The charge voltage Vstg is maintained until another voltage Vg of one scanning signal Sc is applied to the gate G of the first MOS-FET 61 in synchronization with a next frame time signal. Thereafter, when the alternating current exciting signal Sac shown in FIG. 8(*d*) is supplied from the alternating current exciting signal supplying circuit 59 to the second MOS-FET 62, because the second MOS-FET 62 is turned on, a pixel electrode voltage Vp determined by subtracting a gate threshold voltage Vth of the second MOS-FET 62 from the charge voltage Vstg applied to the gate G of the second MOS-FET 62 is applied to the pixel electrode 64*a* of the liquid crystal displaying device 64 through the second MOS-FET 62. A pixel electrode signal Spe having the pixel electrode voltage Vp is shown in FIG. 8(*e*). A frequency of the pixel electrode signal Spe is the same as the exciting frequency of the alternating current exciting signal Sac.

In this case, the charge voltage Vstg relating to the picture voltage Vs of the picture signal Sp, the gate threshold voltage Vth of the second MOS-FET 62, a high level voltage Vach of the alternating current exciting signal Sac and a low level voltage Vacl of the alternating current exciting signal Sac are set to satisfy a following relationship.

$Vstg-|Vth| \leqq Vach$ (in case of the negative (N) channel MOS-FET 62)

$Vstg+|Vth| \geqq Vacl$ (in case of the positive (P) channel MOS-FET 62)

Therefore, when the second MOS-FET 62 is turned on, because the voltage $Vstg-|Vth|$ or $Vstg+|Vth|$ is applied to the pixel electrode 64*a* of the liquid crystal displaying device 64, the pixel electrode voltage Vp applied to the liquid crystal displaying device 64 is changed with the picture voltage Vs of the picture signal Sp.

Accordingly, because an amplitude of the pixel electrode voltage Vp applied to the liquid crystal displaying device 64 is changed with the picture voltage Vs of the picture signal Sp, as shown in FIG. 8(*f*), a differential voltage Vp−Vdc changing with the picture voltage Vs of the picture signal Sp is applied to the liquid crystal displaying device 64, so that a brightness (or luminance) of light emitted from the pixel element 55 depends on the picture voltage Vs of the picture signal Sp. Therefore, an excellent display characteristic in gray scale can be obtained in the liquid crystal displaying apparatus 51.

Also, because a frequency of the alternating current exciting signal Sac supplied to the drain D of the second MOS-FET 62 is independent of a frequency of the scanning signal Sc supplied to the gate G of the first MOS-FET 61, a frequency of the pixel electrode voltage Vp applied to the liquid crystal displaying device 64 can be arbitrarily set. Therefore, because the liquid crystal displaying device 64 can be actuated at a high frequency, any flicker which is caused in an reproduced image by the decrease of a voltage applied to the liquid crystal displaying device 64 can be prevented.

A voltage applied to the liquid crystal displaying device 64 is the differential voltage Vp−Vdc between the pixel electrode voltage Vp and the direct current voltage Vdc applied from the direct current source 58, so that a central value of the differential voltage Vp−Vdc changes with the picture voltage Vs of the picture signal Sp. Therefore, even though the voltage applied to the liquid crystal displaying device 64 is an alternating current voltage, a direct current voltage component remains in the voltage applied to the liquid crystal displaying device 64. In cases where a direct current voltage is applied to the liquid crystal displaying device 64, the liquid crystal layer 78 is degraded because a polarization of liquid crystal occurs in the liquid crystal layer 78. Therefore, it is required to remove the direct current voltage component from the voltage applied to the liquid crystal displaying device 64.

In this embodiment, as shown in FIG. 7, the dielectric layer 77 having a specific resistance sufficiently higher than that of the liquid crystal layer 78 is arranged on the pixel electrode 64*a*, and the direct current voltage component is absorbed in the dielectric layer 77. Therefore, as shown in FIG. 8(*g*), the direct current voltage component is removed from the voltage applied to the liquid crystal displaying device 64, an alternating current voltage symmetric with respect to a zero voltage can be applied to the liquid crystal displaying device 64, so that light can be stably emitted from the liquid crystal displaying device 64 to display one pixel image.

Next, a second embodiment of the present invention is described with reference to FIG. 9.

Figure 9:
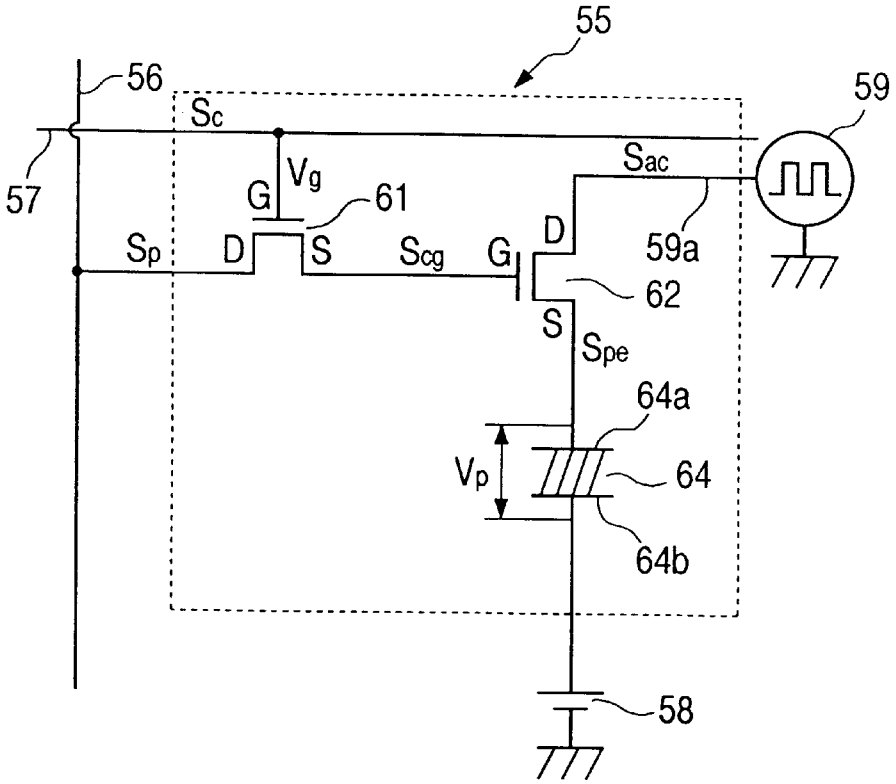
FIG. 9 is a circuit view of a pixel element arranged in the image displaying unit of the matrix type liquid crystal displaying apparatus shown in FIG. 4, according to a second embodiment of the present invention.
Figure 8A:
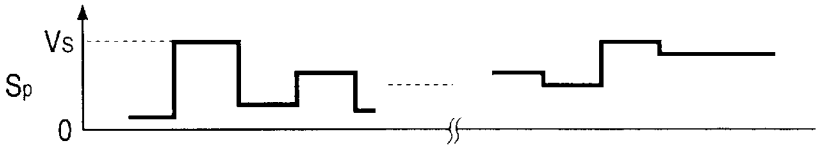
FIGS. 8(*a*) to 8(*g*) show a plurality of waveformes of various signals and voltages used to operate the pixel element shown in FIG. 5.
Figure 8B:
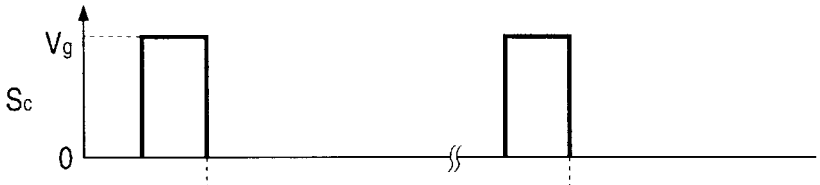
Figure 8C:
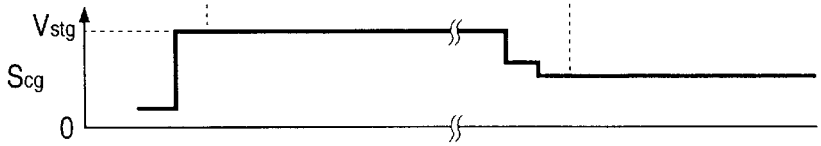
Figure 8D:
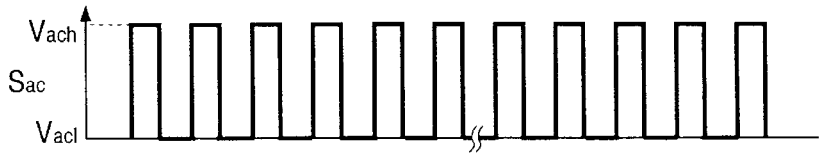
Figure 8E:
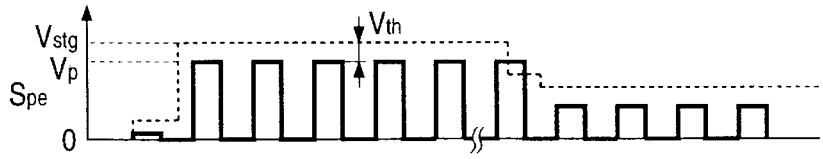
Figure 8F:
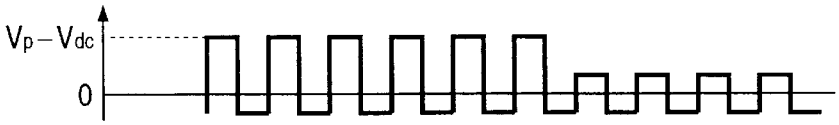
Figure 8G:
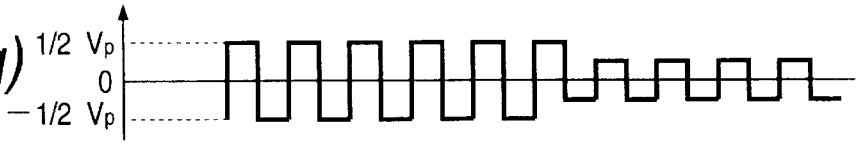

FIG. 9 is a circuit view of a pixel element arranged in the image displaying unit 54 of the matrix type liquid crystal displaying apparatus 51, according to a second embodiment of the present invention. In the second embodiment, the condenser 63 is omitted from each pixel element.

In detail, as shown in FIG. 9, each of the pixel elements 55 comprises the first MOS-FET 61, the second MOS-FET 62, and the liquid crystal displaying device 64.

In the above configuration, an electrostatic capacitance of the gate oxide film 73 of the second MOS-FET 62, an electrostatic capacitance of a depletion layer existing in the gate G of the second MOS-FET 62 and an electrostatic capacitance of a diffusing layer existing in the source S of the first MOS-FET 61 are used as a condenser in place of the condenser 63. Therefore, even though the condenser 63 is omitted from the pixel element 55, the charge voltage Vstg applied to the gate G of the second MOS-FET 62 is maintained until another voltage Vg of one scanning signal Sc is applied to the gate G of the first MOS-FET 61 because charges causing the charge voltage Vstg are stored in the gate oxide film 73, the depletion layer and the diffusing layer.

Accordingly, because the condenser 63 is not required, the pixel element 55 can be downsized. Therefore, a larger number of pixel elements 55 can be arranged in the image displaying unit 54, and a high integration of the image displaying unit 54 can be performed.

Next, a third embodiment of the present invention is described with reference to FIGS. 10(*a*) to 10(*c*) and FIGS. 11(*a*) to 11(*c*).

FIGS. 10(*a*) to 10(*c*) show waveforms of one scanning signal Sc, the alternating current exciting signal Sac, the charge voltage Vstg and the pixel electrode voltage Vp on condition that the alternating current exciting signal Sac indicates the high alternating current voltage Vach at a time of a trailing edge of the scanning signal Sc, and FIGS. 11(*a*) to 11(*c*) show waveforms of one scanning signal Sc, the alternating current exciting signal Sac, the charge voltage Vstg and the pixel electrode voltage Vp on condition that the alternating current exciting signal Sac indicates the low alternating current voltage Vacl at a time of a trailing edge of the scanning signal Sc.

In general, a parasitic capacitance exists between a pair of terminals of a field effect transistor. In particular, a parasitic capacitance existing between the drain D of the second MOS-FET 62 and the gate G of the second MOS-FET 62 functions as a line through which the alternating current exciting signal Sac supplied to the drain D of the second MOS-FET 62 is transmitted to the gate G of the second MOS-FET 62, so that a following problem occurs. That is, because the charge voltage Vstg applied to the gate G of the second MOS-FET 62 is adversely influenced by the alternating current exciting signal Sac applied to the drain D of the second MOS-FET 62 through the parasitic capacitance, a value of the charge voltage Vstg determined in cases where the high alternating current voltage Vach of the alternating current exciting signal Sac is applied to the drain D of the second MOS-FET 62 at a time of a trailing edge of the scanning signal Sc supplied to the gate G of the first MOS-FET 61 differs from a value of the charge voltage Vstg determined in cases where the low alternating current voltage Vacl of the alternating current exciting signal Sac is applied to the drain D of the second MOS-FET 62 at a time of a trailing edge of the scanning signal Sc.

In detail, a change of the charge voltage Vstg adversely influenced by the alternating current exciting signal Sac through the parasitic capacitance is expressed by a changing voltage ΔV. A setting process of the pixel electrode voltage Vp applied to the pixel electrode 64*a* of the liquid crystal displaying device 64 is initially described on condition that the high alternating current voltage Vach of the alternating current exciting signal Sac is applied to the drain D of the second MOS-FET 62 at a time of a trailing edge of the scanning signal Sc supplied to the gate G of the first MOS-FET 61.

In this case (refer to FIGS. 10(*a*) and 10(*b*)), as shown in FIG. 10(*c*), a gate voltage applied to the gate G of the second MOS-FET 62 is maintained to the charge voltage Vstg during a period that the high alternating current voltage Vach of the alternating current exciting signal Sac is applied to the drain D of the second MOS-FET 62, and the gate voltage applied to the gate G of the second MOS-FET 62 is decreased to a voltage Vstg−ΔV during a period that the low alternating current voltage Vacl of the alternating current exciting signal Sac is applied to the drain D of the second MOS-FET 62. In cases where the second MOS-FET 62 has an N-channel, the pixel electrode voltage Vp is applied to the pixel electrode 64*a* of the liquid crystal displaying device 64 during a period that the high alternating current voltage Vach of the alternating current exciting signal Sac is applied to the drain D of the second MOS-FET 62. The pixel electrode voltage Vp is set to a value Vstg−Vth obtained by subtracting the gate threshold voltage Vth of the second MOS-FET 62 from the charge voltage Vstg applied to the gate G of the second MOS-FET 62.

In contrast, in cases where the low alternating current voltage Vacl of the alternating current exciting signal Sac is applied to the drain D of the second MOS-FET 62 at a time of a trailing edge of the scanning signal Sc supplied to the gate G of the first MOS-FET 61 (refer to FIGS. 11(*a*) and 11(*b*)), as shown in FIG. 11(*c*), a gate voltage applied to the gate G of the second MOS-FET 62 is maintained to the charge voltage Vstg during a period that the low alternating current voltage Vacl of the alternating current exciting signal Sac is applied to the drain D of the second MOS-FET 62, and the gate voltage applied to the gate G of the second MOS-FET 62 is increased to a voltage Vstg+ΔV during a period that the high alternating current voltage Vach of the alternating current exciting signal Sac is applied to the drain D of the second MOS-FET 62. In cases where the second MOS-FET 62 has an N-channel, the pixel electrode voltage Vp is applied to the pixel electrode 64*a* of the liquid crystal displaying device 64 during a period that the high alternating current voltage Vach of the alternating current exciting signal Sac is applied to the drain D of the second MOS-FET 62. The pixel electrode voltage Vp is set to a value Vstg+ΔV−Vth obtained by subtracting the gate threshold voltage Vth of the second MOS-FET 62 from the voltage Vstg+ΔV applied to the gate G of the second MOS-FET 62.

Therefore, the value Vstg−Vth of the pixel electrode voltage Vp determined in cases where the high alternating current voltage Vach of the alternating current exciting signal Sac is applied to the drain D of the second MOS-FET 62 at a time of a trailing edge of the scanning signal Sc supplied to the gate G of the first MOS-FET 61 differs from the value Vstg+ΔV−Vth of the pixel electrode voltage Vp determined in cases where the low alternating current voltage Vacl of the alternating current exciting signal Sac is applied to the drain D of the second MOS-FET 62 at a time of a trailing edge of the scanning signal Sc. That is, because the brightness of an image displayed on the image displaying unit 54 changes with the value of the pixel electrode voltage Vp, it is required that a phase relationship between the scanning signal Sc applied to the gate G of the first MOS-FET 61 and the alternating current exciting signal Sac applied to the drain D of the second MOS-FET 62 is fixed to either a first case that the high alternating current voltage Vach of the alternating current exciting signal Sac is applied to the drain D of the second MOS-FET 62 at a time of a trailing edge of the scanning signal Sc supplied to the gate G of the first MOS-FET 61 or a second case that the low alternating current voltage Vacl of the alternating current exciting signal Sac is applied to the drain D of the second MOS-FET 62 at a time of a trailing edge of the scanning signal Sc.

Figure 12:
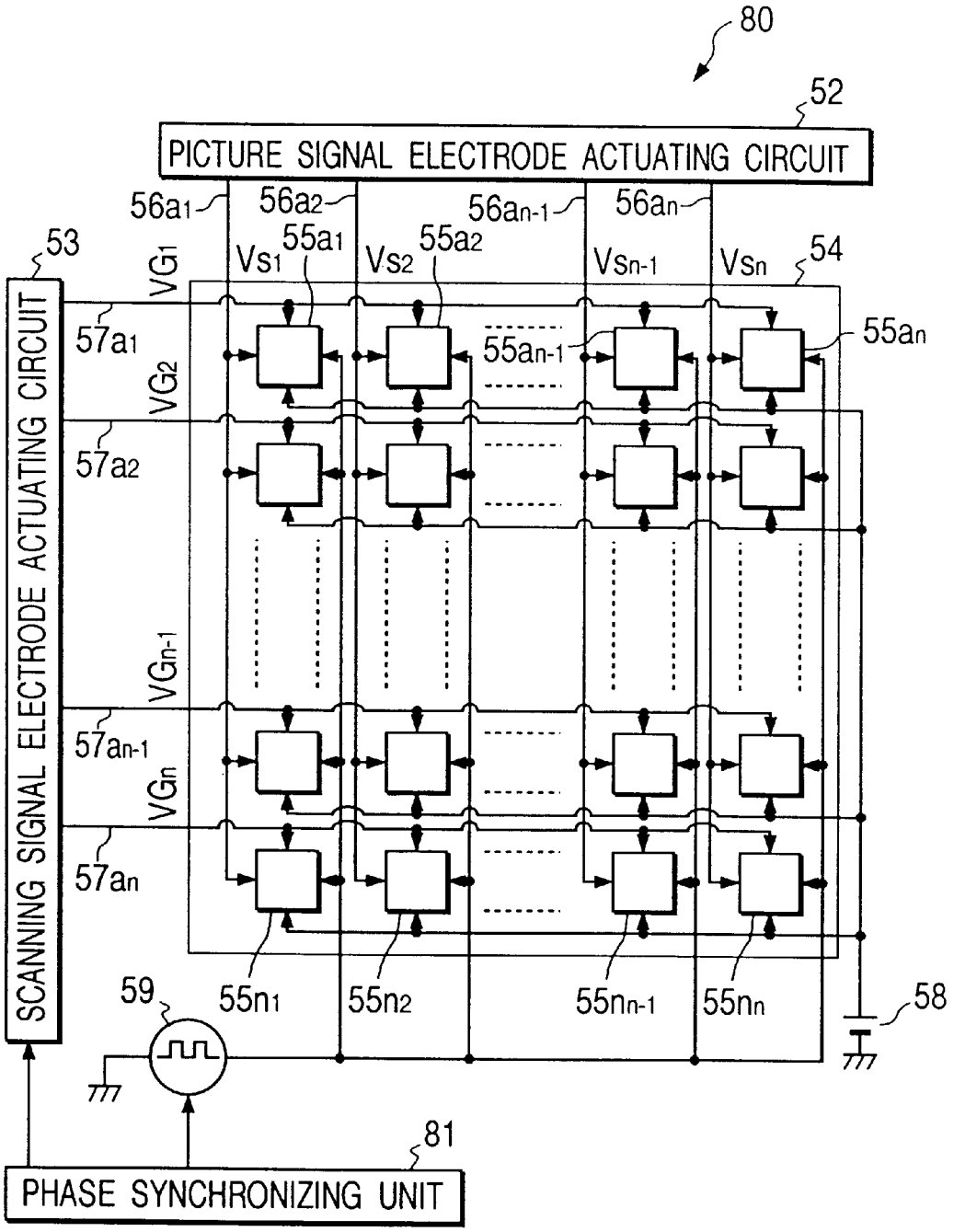
FIG. 12 is a block diagram of a matrix type liquid crystal displaying apparatus according to a third embodiment of the present invention.

FIG. 12 is a block diagram of a matrix type liquid crystal displaying apparatus according to the third embodiment of the present invention.

As shown in FIG. 12, a matrix type liquid crystal displaying apparatus 80 comprises the picture signal electrode actuating circuit 52, the scanning signal electrode actuating circuit 53, the image displaying unit 54, the direct current source 58, the alternating current exciting signal supplying circuit 59, and a phase synchronizing unit 81 for maintaining a phase relationship between the scanning signal Sc applied to the gate G of the first MOS-FET 61 and the alternating current exciting signal Sac applied to the drain D of the second MOS-FET 62 by synchronizing the alternating current exciting signal Sac output from the alternating current exciting signal supplying circuit 59 with the scanning signal Sc output from the scanning signal electrode actuating circuit 53.

In the above configuration, because a phase relationship between the scanning signal Sc applied to the gate G of the first MOS-FET 61 and the alternating current exciting signal Sac applied to the drain D of the second MOS-FET 62 is maintained by the phase synchronizing unit 81, a brightness of the pixel image displayed by the liquid crystal displaying device 64 can accurately depend on the picture voltage Vs of the picture signal Sp, and nonuniformity in brightness between one line of pixel elements 55 and another line of pixel elements 55 can be prevented.

Next, a fourth embodiment of the present invention is described with reference to FIG. 13.

Figure 13:
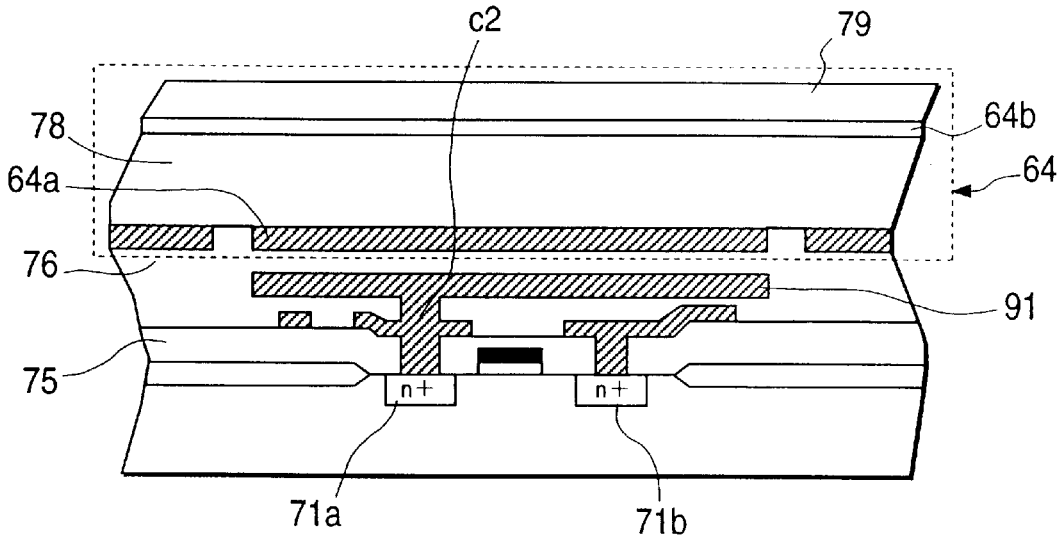
FIG. 13 is a cross sectional view of a combination of a second MOS-FET and a liquid crystal displaying device, according to a fourth embodiment of the present invention.

FIG. 13 is a cross sectional view of a combination of the second MOS-FET 62 and the liquid crystal displaying device 64, according to a fourth embodiment of the present invention.

In the fourth embodiment, as compared with the configuration of the combination of the second MOS-FET 62 and the liquid crystal displaying device 64 shown in FIG. 7, as shown in FIG. 13, the dielectric layer 77 of the liquid crystal displaying device 64 is omitted, and an Al layer 91 connected with the $n^+$ diffused layers 71*a* functioning as the source $S_{62}$ of the MOS-FET 62 is coupled with the pixel electrode 64*a* of the liquid crystal displaying device 64 through the second insulating layer 76.

In the above configuration, because the source $S_{62}$ of the MOS-FET 62 is connected with the pixel electrode 64*a* in capacitive coupling, even though the dielectric layer 77 is omitted from the liquid crystal displaying device 64, the direct current voltage component included in the pixel electrode voltage Vp can be absorbed by the capacitive coupling.

Also, because any conductive line directly connecting the source $S_{62}$ of the MOS-FET 62 and the pixel electrode 64*a* is not required, the contact hole C2 penetrating through the second insulating layer 76 on the source $S_{62}$ of the MOS-FET 62 is not required. Therefore, the flatness of a surface of the pixel electrode 64*a* can be improved, and an effective area of a pixel in each pixel element 55 can be widened.

Next, a fifth embodiment of the present invention is described with reference to FIG. 14.

Figure 14:
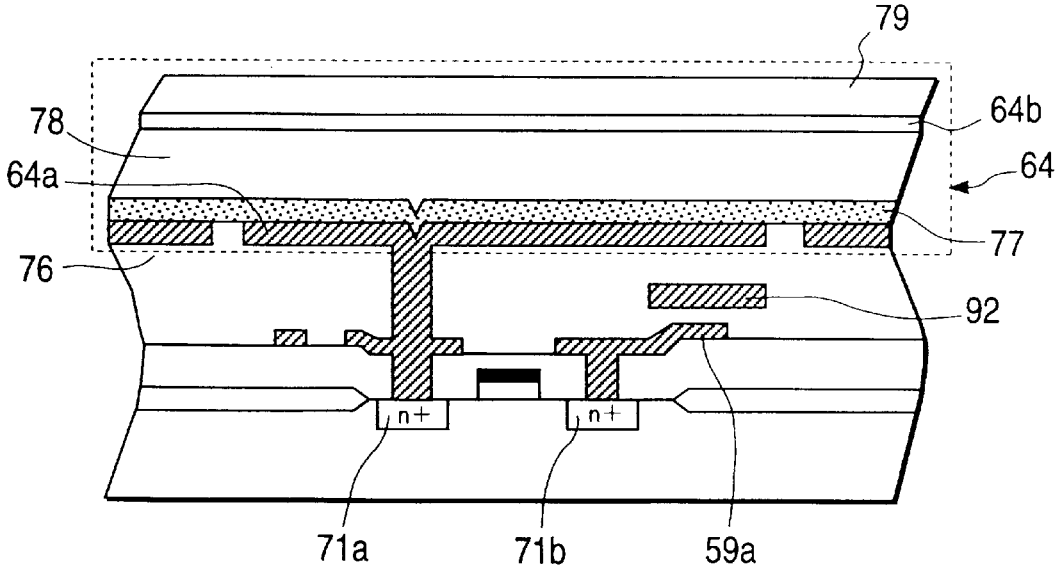
FIG. 14 is a cross sectional view of a combination of a second MOS-FET and a liquid crystal displaying device, according to a fifth embodiment of the present invention.

FIG. 14 is a cross sectional view of a combination of the second MOS-FET 62 and the liquid crystal displaying device 64, according to a fifth embodiment of the present invention.

In the fifth embodiment, as compared with the configuration of the combination of the second MOS-FET 62 and the liquid crystal displaying device 64 shown in FIG. 7, as shown in FIG. 14, an Al shielding layer 92 is additionally arranged between the pixel electrode 64*a* and the common electrode 59*a*.

In the above configuration, even though an electric field is induced in the second insulating layer 76 by the alternating current exciting signal Sac supplied to the common electrode 59*a*, because electric force lines extending from the common electrode 59*a* to the pixel electrode 64*a* are shield by the Al shielding layer 92, the electric field is limited between the Al shielding layer 92 and the common electrode 59*a*. Therefore, an adverse influence of the electric field on an electro-optical characteristic of the crystal liquid layer 78 can be reduced.

Next, a sixth embodiment of the present invention is described with reference to FIGS. 15 to 17.

Figure 15:
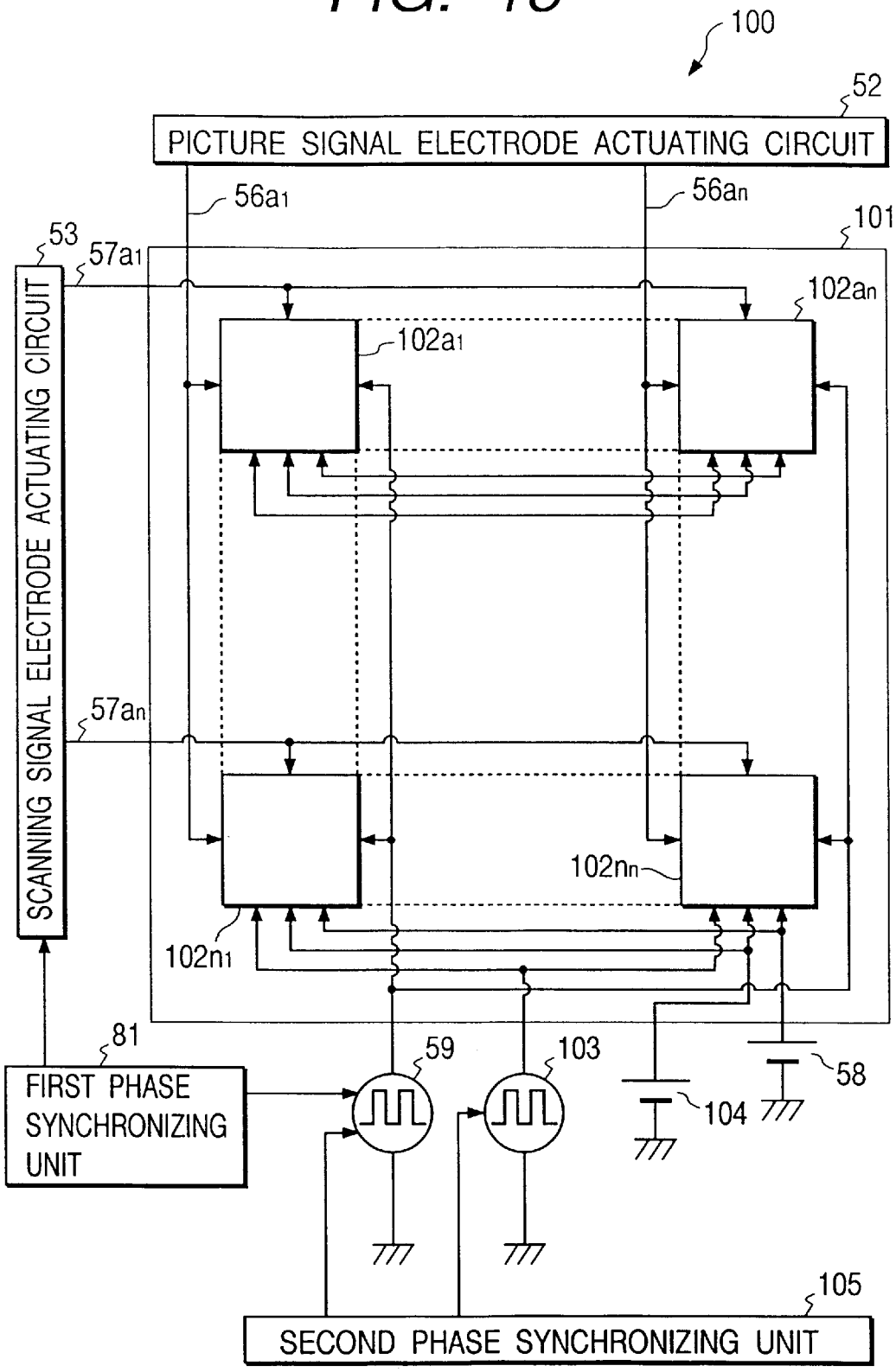
FIG. 15 is a block diagram of a matrix type liquid crystal displaying apparatus according to a sixth embodiment of the present invention.

FIG. 15 is a block diagram of a matrix type liquid crystal displaying apparatus according to the sixth embodiment of the present invention.

As shown in FIG. 15, a matrix type liquid crystal displaying apparatus 100 comprises the picture signal electrode actuating circuit 52, the scanning signal electrode actuating circuit 53, an image displaying unit 101, composed of a plurality of pixel elements 102 (102*a*1 to 102*nn*), for displaying an image according to the picture signal voltages supplied from the picture signal electrode actuating circuit 52 through the picture signal electrodes 56 and the scanning signal voltages supplied from the scanning signal electrode actuating circuit 53 through the scanning signal electrodes 57, the alternating current exciting signal supplying circuit 59, the first phase synchronizing unit 81, a pulse supplying circuit 103 for supplying a series of reset pulses Pr to each of the pixel elements 102, a direct current voltage source 104 for applying a reference voltage Vrst to one pixel element 102 each time one reset pulse Pr is supplied from the pulse supplying circuit 103 to the pixel element 102, the direct current source 58 for supplying a direct current voltage Vdc substantially equal to the reference voltage Vrst to each of the pixel elements 102 of the image displaying unit 101, and a second phase synchronizing unit 105 for maintaining a phase relationship between each reset pulse Pr supplied from the pulse supplying circuit 103 and the alternating current exciting signal Sac applied to the drain D of the second MOS-FET 62 by synchronizing each reset pulse Pr with the alternating current exciting signal Sac output from the alternating current exciting signal supplying circuit 59.

In the image displaying unit 101, the pixel elements 102*a*1, 102*a*2, . . . , 102*an*, . . . ,102*n*1, 102*n*2, . . . , 102*nn* are arranged in the X and Y directions in a matrix layout. An alternating current exciting signal Sac is supplied from the alternating current exciting signal supplying circuit 59 to each of the pixel elements 102 of the image displaying unit 101, and a direct current voltage Vdc is supplied from the direct current source 58 to the common electrode 64*b* of the liquid crystal displaying device 64.

Next, a configuration of each pixel element 102 according to the sixth embodiment is described.

FIG. 16 is a circuit view of one pixel element 102 arranged in the image displaying unit 101 of the matrix type liquid crystal displaying apparatus 100, according to the sixth embodiment of the present invention.

As shown in FIG. 16, each of the pixel elements 102 comprises the first MOS-FET 61, the second MOS-FET 62, the first condenser 63 for charging a voltage (or a charge voltage) Vstg to the gate G of the second MOS-FET 62 and discharging the charge voltage Vstg to the earth, the liquid crystal displaying device 64, a second condenser 106 for removing a direct current voltage component included in a source pulse signal Ssp which is output from the source S of the second MOS-FET 62 at a picture voltage Vs, and a third MOS-FET 107 in which the reference voltage Vrst of the direct current voltage source 104 is transmitted from a source to a drain when one reset signal of the pulse supplying circuit 103 is applied to a gate and applying an alternating current pulse signal Sacp symmetric with respect to the reference voltage Vrst to the liquid crystal displaying device 64.

In the above configuration, an operation of each pixel element 102 is described with reference to FIGS. 17(*a*) to 17(*d*).

When one voltage Vg of one scanning signal Sc is applied from the scanning signal electrode actuating circuit 53 to the gate G of the first MOS-FET 61 through one scanning signal electrode 57 in synchronization with one frame time signal on condition that one picture voltage Vs of one picture signal Sp is applied from the picture signal electrode actuating circuit 52 to the drain D of the first MOS-FET 61 through one picture signal electrode 56, the first MOS-FET 61 is turned on, the picture signal Sp having the picture voltage Vs is transmitted through the first MOS-FET 61, and a charge voltage Vstg shown in FIG. 17(*b*) is applied to the gate G of the second MOS-FET 62. Therefore, the second MOS-FET 62 is turned on. The charge voltage Vstg is maintained until another voltage Vg of one scanning signal Sc is applied to the gate G of the first MOS-FET 61 in synchronization with a next frame time signal.

Thereafter, the alternating current exciting signal Sac shown in FIG. 17(*a*) is supplied from the alternating current exciting signal supplying circuit 59 to the drain D of the second MOS-FET 62, and a source pulse signal Ssp is output from the source S of the second MOS-FET 62 at a picture voltage Vs. As shown in FIG. 17(*b*), the picture voltage Vs is determined by subtracting the gate threshold voltage Vth of the second MOS-FET 62 from the charge voltage Vstg applied to the gate G of the second MOS-FET 62. Thereafter, a direct current component is removed from the source pulse signal Ssp in the second condenser 106.

Also, a series of reset pulses Pr shown in FIG. 17(*c*) is supplied from the pulse supplying circuit 103 to a gate G of the third MOS-FET 107, and the third MOS-FET 107 is turned on in synchronization with each of the reset pulses Pr. In this case, the reset pulses Pr are synchronized with the alternating current exciting signal Sac output from the alternating current exciting signal supplying circuit 59 by the function of the second phase synchronizing unit 105. That is, a first group of reset pulses Pr are output just before leading edges of the alternating current exciting signal Sac, a second group of reset pulses Pr are output just before trailing edges of the alternating current exciting signal Sac, the reset pulses Pr of the first group and the reset pulses Pr of the second group are alternately supplied to the gate G of the third MOS-FET 107. Therefore, a reference voltage Vrst of the direct current voltage source 104 is applied to a connecting line between the second condenser 106 and the liquid crystal displaying device 64 each time one reset pulse Pr is supplied to the third MOS-FET 107. Because the source pulse signal Ssp synchronized with the alternating current exciting signal Sac is supplied to the second condenser 106, as shown in FIG. 17(*d*), an alternating current pulse signal Sacp symmetric with respect to the reference voltage Vrst is supplied to the liquid crystal displaying device 64.

In detail, when one reset pulse Pr having a voltage Vq is applied to the gate G of the third MOS-FET 107 just before one leading edge of the alternating current exciting signal Sac, a voltage applied to the liquid crystal displaying device 64 is increased to the reference voltage Vrst. Thereafter, the voltage applied to the liquid crystal displaying device 64 is moreover increased to a highest value with the source pulse signal Ssp having the picture voltage Vs. Also, when one reset pulse Pr having the voltage Vq is applied to the gate G of the third MOS-FET 107 just before one trailing edge of the alternating current exciting signal Sac, a voltage applied to the liquid crystal displaying device 64 is decreased to the reference voltage Vrst. Thereafter, the voltage applied to the liquid crystal displaying device 64 is moreover decreased to a lowest value with the source pulse signal Ssp having the picture voltage Vs. Therefore, the alternating current pulse signal Sacp symmetric with respect to the reference voltage Vrst can be supplied to the liquid crystal displaying device 64.

In this case, because the direct current voltage Vdc substantially equal to the reference voltage Vrst is applied from the direct current source 58 to the common electrode 64*b* of the liquid crystal displaying device 64, the liquid crystal displaying device 64 is actuated by a pixel electrode voltage Vp of the alternating current pulse signal Sacp having no direct current voltage component (FIG. 17(*d*)).

Accordingly, because the direct current voltage component of the source pulse signal Ssp having the same frequency as that of the alternating current exciting signal Sac is removed in the second condenser 106 and the liquid crystal displaying device 64 is actuated by the pixel electrode voltage Vp having no direct current voltage component, light is emitted from the liquid crystal displaying device 64 in synchronization with pulses of the alternating current exciting signal Sac, a life time of the liquid crystal of the liquid crystal displaying device 64 can be prolonged, and any baking of the liquid crystal can be prevented.

Also, the frequency of the alternating current pulse signal Sacp is the same as that of the alternating current exciting signal Sac, any flicker which is caused in an reproduced image by the decrease of a voltage applied to the liquid crystal displaying device 64 can be prevented.

Next, a relationship between a capacitance Cc of the second condenser 106 and a capacitance $C_{LC}$ of the liquid crystal displaying device 64 is described.

After the voltage Vq of one reset pulse Pr is applied to the gate G of the third MOS-FET 107, the third MOS-FET 107 is turned off, and the voltage Vsp of the source pulse signal Ssp output from the second MOS-FET 62 is changed by ΔVsp. In this case, the pixel electrode voltage Vp applied to the pixel electrode 64*a* of the liquid crystal displaying device 64 is also changed by ΔVp. The relationship between ΔVsp and ΔVp is formulated as follows.

$$\Delta Vp=\{Cc/(Cc+C_{LC})\}*\Delta VSP$$

Because the alternating current pulse signal Sacp supplied to the liquid crystal displaying device 64 is symmetric with the reference voltage Vrst and has an amplitude of 2*Vp, an amplitude change (2*ΔVp) of the alternating current pulse signal Sacp is equal to an amplitude change (ΔVsp) of the source pulse signal Ssp in cases where 2*ΔVp=ΔVsp is satisfied. Therefore, because a display voltage Vd effectively used in the liquid crystal displaying device 64 to display an image is equal to 2*Vp, in cases where ΔVp≧ΔVsp/2 is satisfied, the image can be reliably displayed in the matrix type liquid crystal displaying apparatus 100. To satisfy the relationship ΔVp≧ΔVsp/2, it is required that a relationship $Cc \geqq C_{LC}$.

In the above embodiments, the MOS-FETs 61, 62 and 107 are formed on the single-crystal Si substrate 72. However, it is applicable that a thin film transistor (TFT) be formed on a semiconductor substrate or an insulating substrate.

Having illustrated and described the principles of the present invention in a preferred embodiment thereof, it should be readily apparent to those skilled in the art that the invention can be modified in arrangement and detail without departing from such principles. We claim all modifications coming within the scope of the accompanying claims.

What is claimed is:

1. A liquid crystal displaying apparatus, comprising:

a plurality of pixel elements arranged from a first line of a first column to an M-th line of an N-th column (N and M are respectively an integral number) in a matrix layout;

a picture signal electrode actuating circuit for outputting a plurality of N picture signals having picture voltages to N picture signal electrodes in one-to-one correspondence every one horizontal scanning period, each of the picture signal electrodes being connected with one column of M pixel elements;

a scanning signal electrode actuating circuit for outputting a plurality of M scanning signals having a scanning voltage M scanning signal electrodes in one-to-one correspondence every one frame period corresponding to M horizontal scanning periods, each of the scanning signal electrodes being connected with one line of N pixel elements; and an alternating current exciting signal outputting circuit for outputting an alternating current exciting signal having a plurality of exciting pulses of an exciting voltage and an exciting frequency, each of the pixel elements comprising:

a first switch for receiving one picture signal output from the picture signal electrode actuating circuit through one picture signal electrode and outputting a charge signal set at a charge voltage relating to the picture voltage of the picture signal in cases where one scanning signal output from the scanning signal electrode actuating circuit through one scanning signal electrode is received;

a second switch having a control terminal, a first main terminal and a second main terminal, said first main terminal connected to said alternating current exciting signal outputting circuit for receiving the exciting pulses of the alternating current exciting signal output from the alternating current exciting signal outputting circuit, said control terminal connected for receiving the charge signal from the first switch, said second main terminal connected for outputting a pixel element signal, of which a pixel electrode voltage is determined according to the charge voltage of the charge signal set by the first switch and a frequency is the same as the exciting frequency of the alternating current exciting signal, in cases where the charge signal is received; and a liquid crystal displaying element for displaying a pixel image in a gray scale according to the pixel element signal output from the second switch on condition that a brightness of the pixel image changes with the pixel electrode voltage of the pixel element signal.

2. A liquid crystal displaying apparatus according to claim 1, further comprising:

a charging voltage maintaining circuit for maintaining the charge voltage of the charge signal output from the first field effect transistor until a next scanning signal is received by the first field effect transistor.

3. A liquid crystal displaying apparatus according to claim 1 in which the first switch comprises a first field effect transistor having a gate connected with the scanning signal electrode, a first main terminal connected with the picture signal electrode and the charge signal is output from a second main terminal, and the second switch comprises a second field effect transistor in which said control terminal comprises a gate connected with the second main terminal of the first field effect transistor and said second main terminal is connected with the liquid crystal displaying element.

4. A liquid crystal displaying apparatus according to claim 2 in which the charging voltage maintaining circuit comprises a condenser in which one terminal is connected with the second main terminal of the first field effect transistor and the gate of the second field effect transistor.

5. A liquid crystal displaying apparatus, comprising:

a plurality of pixel elements arranged from a first line of a first column to an M-th line of an N-th column (N and M are respectively an integral number) in a matrix layout;

a picture signal electrode actuating circuit for outputting a plurality of N picture signals having picture voltages to N picture signal electrodes in one-to-one correspondence every one horizontal scanning period each of the picture signal electrodes being connected with one column of M pixel elements;

a scanning signal electrode actuating circuit for outputting a plurality of M scanning signals having a scanning voltage M scanning signal electrodes in one-to-one correspondence every one frame period corresponding to M horizontal scanning periods, each of the scanning signal electrodes being connected with one line of N pixel elements; and an alternating current exciting signal outputting circuit for outputting an alternating current exciting signal having a plurality of exciting pulses of an exciting voltage and an exciting frequency, each of the pixel elements comprising:

a first field effect transistor, having a gate, a first main terminal and a second main terminal, for receiving one picture signal output from the picture signal electrode actuating circuit through the first main terminal, receiving one scanning signal output from the scanning signal electrode actuating circuit through the gate and outputting a charge signal set at a charge voltage relating to the picture voltage of the picture signal through the second main terminal;

a second field effect transistor, having a gate, a first main terminal and a second main terminal, for receiving the exciting pulses of the alternating current exciting signal output from the alternating current exciting signal outputting circuit through the first main terminal, receiving the charge signal from the first field effect transistor through the gate and outputting through the second main terminal a pixel element signal, of which a pixel electrode voltage is determined according to the charge voltage of the charge signal set by the first field effect transistor and a frequency is the same as the exciting frequency of the alternating current exciting signal, the exciting voltage of the alternating current exciting signal being positive and being equal to or greater than a differential voltage obtained by subtracting a threshold voltage of the second field effect transistor from the charge voltage of the charge signal applied to the gate of the second field effect transistor in cases where the second field effect transistor has an N channel, and the exciting voltage of the alternating current exciting signal being negative and being equal to or lower than a differential voltage obtained by adding the threshold voltage of the second field effect transistor and the charge voltage of the charge signal applied to the gate of the second field effect transistor in cases where the second field effect transistor has a P channel, and a liquid crystal displaying element for displaying a pixel image according to the pixel element signal output from the second field effect transistor on condition that a brightness of the pixel image depends on the pixel electrode voltage of the pixel element signal.

6. A liquid crystal displaying apparatus according to claim 5 in which a dielectric layer having a specific resistance higher than that of a liquid crystal layer of the liquid crystal displaying element is arranged on the liquid crystal displaying element to absorb a direct current voltage component included in the pixel element signal in the dielectric layer.

7. A liquid crystal displaying apparatus according to claim 5, further comprising a phase synchronizing unit for synchronizing the alternating current exciting signal output from the alternating current exciting signal outputting circuit with the scanning signal applied to the gate of the first field effect transistor to fix a phase relationship between the scanning signal and the alternating current exciting signal.

8. A liquid crystal displaying apparatus according to claim 5 in which a metallic layer is arranged on the second main terminal of the second field effect transistor, a pixel electrode is arranged on the liquid crystal displaying element, and an insulating layer is arranged between the metallic layer and the pixel electrode to connect the second field effect transistor and the liquid crystal displaying element in capacitive coupling.

9. A liquid crystal displaying apparatus according to claim 1 in which a common line connects the alternating current exciting signal outputting circuit and the first main terminal of the second field effect transistor, a pixel electrode is arranged on the liquid crystal displaying element to be connected with the second main terminal of the second field effect transistor, and a metallic shielding layer is arranged between the common line and the pixel electrode.

10. A liquid crystal displaying apparatus, comprising:

a plurality of pixel elements arranged from a first line of a first column to an M-th line of an N-th column (N and M are respectively an integral number) in a matrix layout;

a picture signal electrode actuating circuit for outputting a plurality of N picture signals having picture voltages to N picture signal electrodes in one-to-one correspondence every one horizontal scanning period, each of the picture signal electrodes being connected with one column of M pixel elements;

a scanning signal electrode actuating circuit for outputting a plurality of M scanning signals having a scanning voltage to M scanning signal electrodes in one-to-one correspondence every one frame period corresponding to M horizontal scanning periods, each of the scanning signal electrodes being connected with one line of N pixel elements;

an alternating current exciting signal outputting circuit for outputting an alternating current exciting signal having a plurality of exciting pulses of an exciting voltage and an exciting frequency;

a pulse supplying circuit for supplying a plurality of reset pulses of a reset pulse signal to each of the pixel elements;

a direct current voltage source for applying a reference voltage to each of the pixel elements; and a phase synchronizing unit for synchronizing the reset pulse signal output from the pulse supplying circuit with the alternating current exciting signal output from the alternating current exciting signal outputting circuit to output one first reset pulse of the reset pulse signal just before one leading edge of each exciting pulse of the alternating current exciting signal and output one second reset pulse of the reset pulse signal just before one trailing edge of each exciting pulse of the alternating current exciting signal, each of the pixel elements comprising a first field effect transistor for receiving one picture signal output from the picture signal electrode actuating circuit through one picture signal electrode at a first main terminal and outputting a charge signal set at a charge voltage relating to the picture voltage of the picture signal from a second main terminal in cases where one scanning signal output from the scanning signal electrode actuating circuit through one scanning signal electrode is received at a gate;

a second field effect transistor for receiving the charge signal output from the first field effect transistor at a gate, receiving the alternating current exciting signal output from the alternating current exciting signal outputting circuit at a first main terminal and outputting a source pulse signal of which a source pulse voltage is determined according to the charge voltage of the charge signal and a frequency is the same as the exciting frequency of the alternating current exciting signal;

a condenser, of which one terminal is connected with the second main terminal of the second field effect transistor and the other terminal is connected with a connecting line, for removing a direct current voltage component from the source pulse signal output from the second field effect transistor;

a third field effect transistor for receiving the reset pulses of the reset pulse signal output from the pulse supplying circuit at a gate, receiving the reference voltage applied from the direct current voltage source at a second main terminal and outputting an alternating current pulse signal from a first main terminal to the connecting line on condition that a pixel electrode voltage of the alternating current pulse signal is reset to the reference voltage in synchronization with each of the reset pulses, the pixel electrode voltage reset to the reference voltage in synchronization with each first reset pulse is increased to a highest value relating to the source pulse voltage of the source pulse signal applied to the condenser and the pixel electrode voltage reset to the reference voltage in synchronization with each second reset pulse is decreased to a lowest value relating to the source pulse voltage of the source pulse signal applied to the condenser; and a liquid crystal displaying element for displaying a pixel image according to the alternating current pulse signal output from the third field effect transistor through the connecting line on condition that a brightness of the pixel image depends on the pixel electrode voltage of the alternating current pulse signal.

11. A liquid crystal displaying apparatus according to claim 10 in which the exciting voltage of the alternating current exciting signal is positive and is equal to or higher than a differential voltage obtained by subtracting a threshold voltage of the second field effect transistor from the charge voltage of the charge signal applied to the gate of the second field effect transistor in cases where the second field effect transistor has an N channel, and the exciting voltage of the alternating current exciting signal is negative and is equal to or lower than a differential voltage obtained by adding the threshold voltage of the second field effect transistor and the charge voltage of the charge signal applied to the gate of the second field effect transistor in cases where the second field effect transistor has a P channel.

12. A liquid crystal displaying apparatus according to claim 10 in which a capacity of the condenser is equal to or higher than a capacity of the liquid crystal displaying element.

* * * * *

UNITED STATES PATENT AND TRADEMARK OFFICE

CERTIFICATE OF CORRECTION

PATENT NO. : 5,926,160
DATED : July 20, 1999
INVENTOR(S) : Masato FURUYA

It is certified that error appears in the above-identified patent and that said Letters Patent is hereby corrected as shown below:

On the title page, item [30],

Foreign Application Priority Data:

delete "July 31, 1995 [JP] Japan ...7-215355"

Signed and Sealed this

Twenty-sixth Day of September, 2000

*Attest:*

Q. TODD DICKINSON

*Attesting Officer*

*Director of Patents and Trademarks*